US008306453B2

(12) United States Patent
Saiki et al.

(10) Patent No.: US 8,306,453 B2
(45) Date of Patent: Nov. 6, 2012

(54) IMAGE FORMING UNIT AND IMAGE FORMING APPARATUS PROVIDED THEREWITH

(75) Inventors: Atsuna Saiki, Saitama (JP); Toyohiko Awano, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 682 days.

(21) Appl. No.: 12/543,924

(22) Filed: Aug. 19, 2009

(65) Prior Publication Data

US 2010/0247198 A1 Sep. 30, 2010

(30) Foreign Application Priority Data

Mar. 27, 2009 (JP) ..... 2009-080185

(51) Int. Cl.
*G03G 15/00* (2006.01)
*G03G 21/18* (2006.01)

(52) U.S. Cl. ..... 399/113; 399/110

(58) Field of Classification Search ..... 399/113, 399/110, 111
See application file for complete search history.

(56) References Cited

U.S. PATENT DOCUMENTS

| | | | | |
|---|---|---|---|---|
| 2002/0181968 | A1 | 12/2002 | Okimura et al. | 399/111 |
| 2003/0053819 | A1 | 3/2003 | Nomura et al. | |
| 2003/0161656 | A1 | 8/2003 | Miura et al. | 399/116 |
| 2003/0228171 | A1 | 12/2003 | Miyabe et al. | 399/111 |
| 2005/0147432 | A1 | 7/2005 | Miura et al. | 399/250 |
| 2006/0245786 | A1 | 11/2006 | Suzuki | 399/111 |
| 2009/0162087 | A1 | 6/2009 | Suzuki et al. | |

FOREIGN PATENT DOCUMENTS

| | | |
|---|---|---|
| JP | 5-100507 | 4/1993 |
| JP | 7-072675 | 3/1995 |
| JP | 9-309643 | 12/1997 |
| JP | 2002-062743 | 2/2002 |
| JP | 2002-108049 | 4/2002 |
| JP | 2002-196650 | 7/2002 |
| JP | 2003-050531 | 2/2003 |
| JP | 2003-316233 | 11/2003 |
| JP | 2005-037512 | 2/2005 |
| JP | 2006-308802 | 11/2006 |
| JP | 2006-350379 | 12/2006 |
| JP | 3959601 B | 5/2007 |
| JP | 2007-193302 | 8/2007 |
| JP | 2008-026364 | 2/2008 |
| JP | 2008-134408 | 6/2008 |

*Primary Examiner* — Sophia S Chen
(74) *Attorney, Agent, or Firm* — Sughrue Mion, PLLC

(57) ABSTRACT

An aspect of the present invention provides an image forming unit including: a development unit that includes a development member; a photosensitive unit that includes a photosensitive member; a transfer unit that is disposed to face the photosensitive member; and an elastic member that is attached to the transfer unit and the development unit and urges the development unit toward the transfer unit to align the development unit and the photosensitive member with each other.

8 Claims, 20 Drawing Sheets

IMAGE FORMING UNIT AND IMAGE FORMING APPARATUS PROVIDED THEREWITH

CROSS-REFERENCE TO RELATED APPLICATION

This application is based on and claims priority under 35 USC 119 from Japanese Patent Application No. 2009-080185 filed Mar. 27, 2009.

BACKGROUND

1. Technical Field

The present invention relates to an image forming unit and an image forming apparatus provided therewith.

2. Related Art

As is well known in an electrophotographic image forming apparatus, in consideration of maintenance, a process portion that performs an image forming process is formed into cartridge structure to obtain a maintenance-free configuration.

SUMMARY

In accordance with an aspect of the invention, an image forming unit includes: a development unit that includes a development member; a photosensitive unit that includes a photosensitive member; a transfer unit that is disposed to face the photosensitive member; and an elastic member that is attached to the transfer unit and the development unit and urges the development unit toward the transfer unit to align the development unit and the photosensitive member with each other.

BRIEF DESCRIPTION OF THE DRAWINGS

Exemplary embodiments of the invention will be described in detail with reference to the following figures, wherein.

DETAILED DESCRIPTION

An exemplary embodiment of the invention will be described below.

(Entire Configuration)

Figure 1:
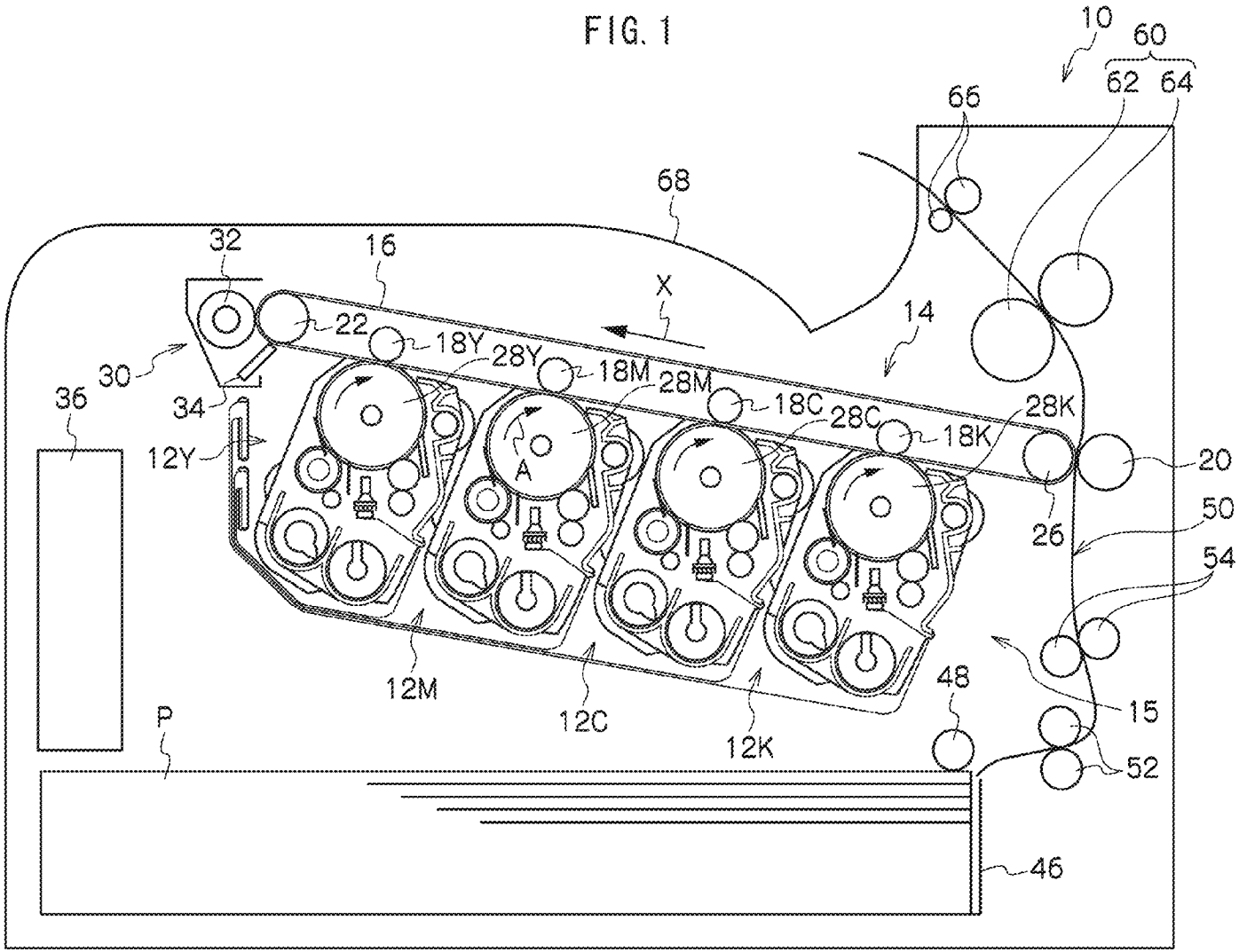
FIG. 1 is a front view schematically illustrating an image forming apparatus according to an exemplary embodiment of the invention.

FIG. 1 illustrates a printer 10 that is of an image forming apparatus. The printer 10 is a digital printer that forms a color image or a monochrome image. An image processing device (not illustrated in the drawings) is provided inside the printer 10. The image processing device performs image processing to image data transmitted from a personal computer or the like.

Figure 2:
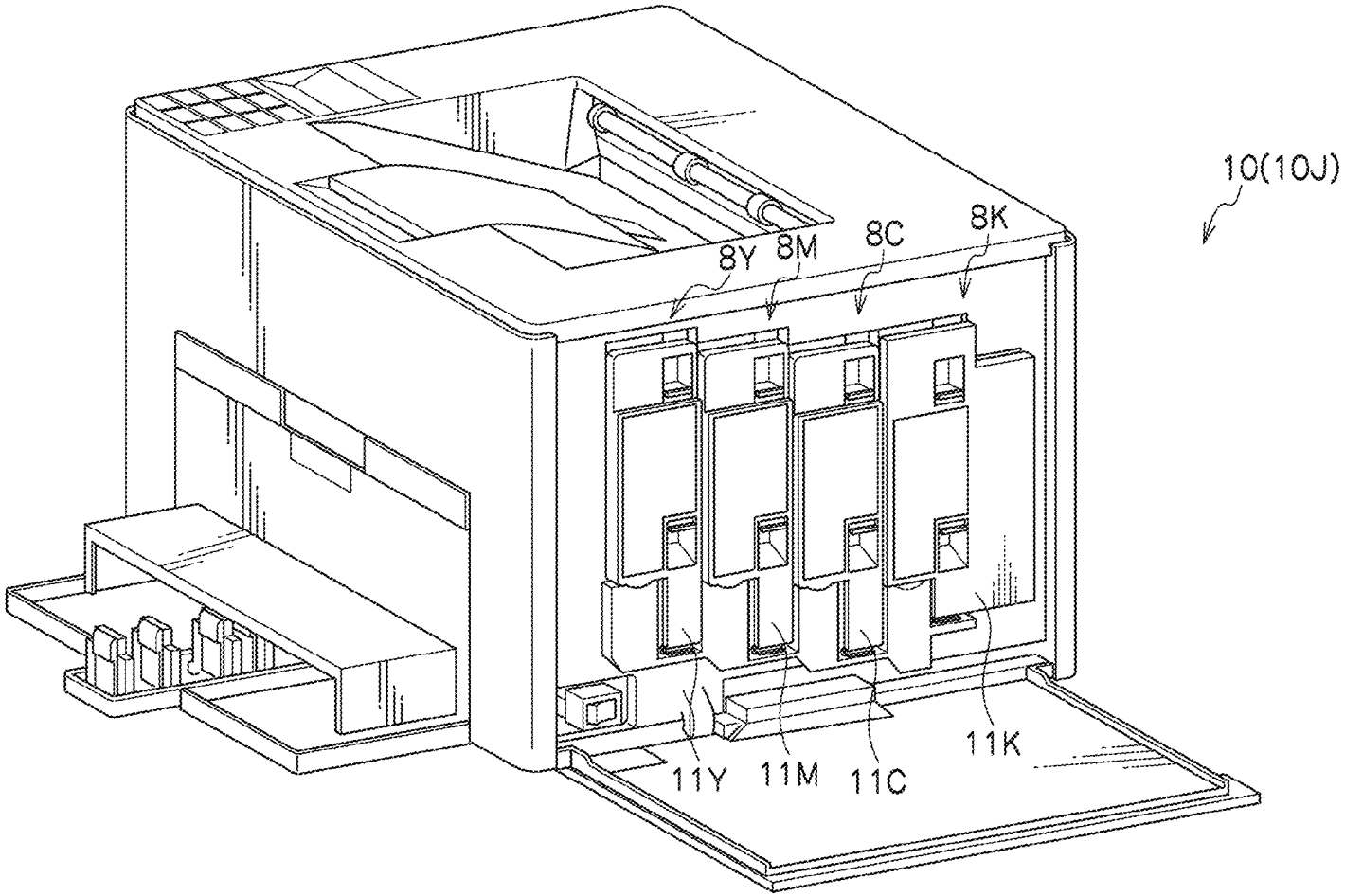
FIG. 2 is a perspective view illustrating an arrangement of a toner cartridge in the image forming apparatus of the exemplary embodiment.
Figure 3:
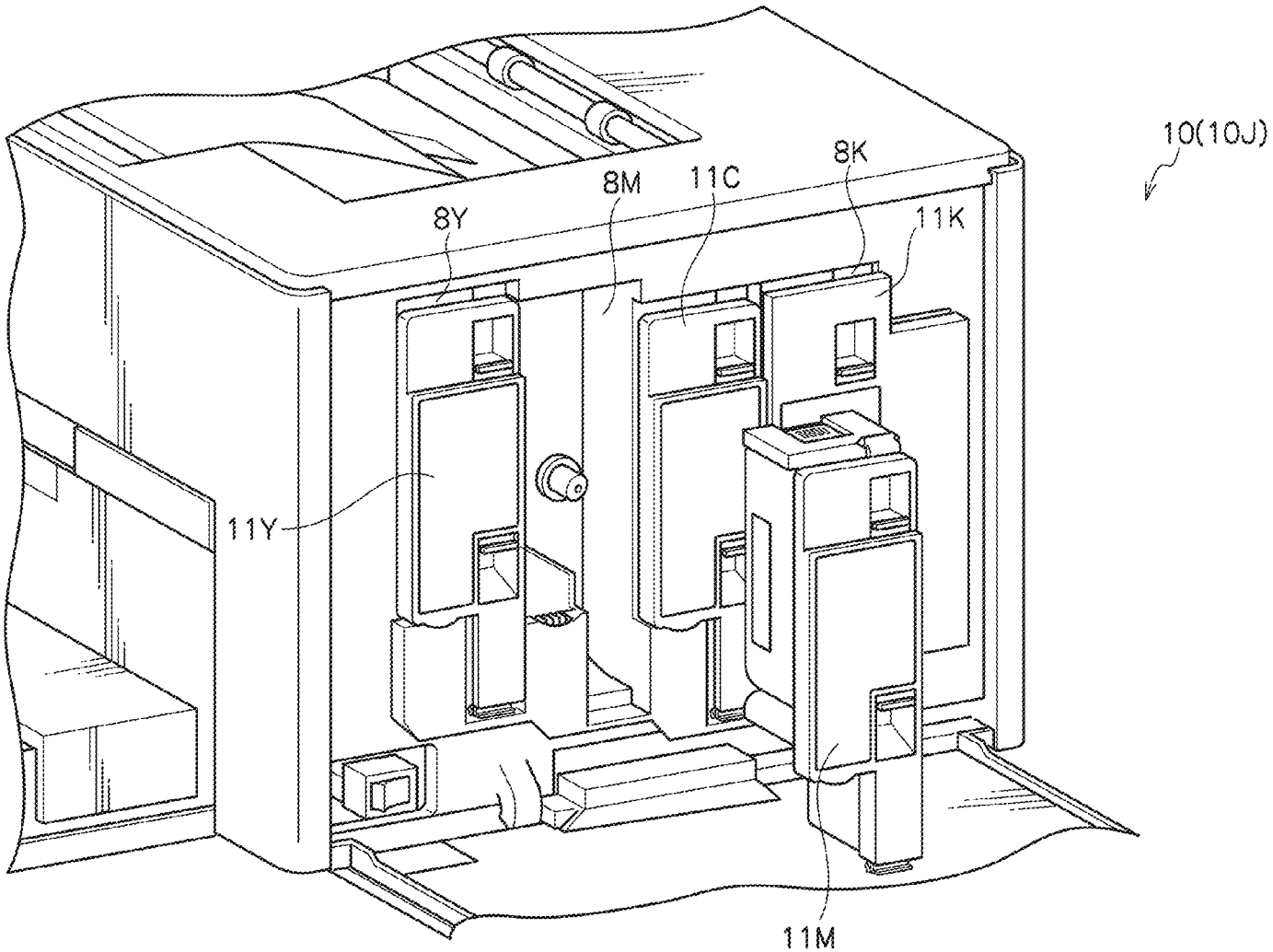
FIG. 3 is a partially enlarged perspective view explaining attachment and detachment of the toner cartridge in the image forming apparatus of the exemplary embodiment.

As illustrated in FIGS. 2 and 3, toner cartridges 11Y, 11M, 11C, and 11K are attached to a side part inside the printer 10. Yellow (Y) toner, magenta (M) toner, cyan (C) toner, and black (K) toner are respectively stored in the toner cartridges 11Y, 11M, 11C, and 11K. Cartridge accommodating portions 8Y, 8M, 8C, and 8K are formed, in the side part inside the printer 10, according to dimensions of the toner cartridges 11Y, 11M, 11C, and 11K. The toner cartridges 11Y, 11M, 11C, and 11K are detachably accommodated in the cartridge accommodating portions 8Y, 8M, 8C, and 8K. Therefore, the toner cartridges 11Y, 11M, 11C, and 11 are exchangeably (detachably) provided in a printer main body 10J. In the following description, members corresponding to the yellow, magenta, cyan, and black colors are distinguished from one another by adding suffixes Y, M, C, and K.

As illustrated in FIGS. 1, 4, 5, and 7, four image forming units 12Y, 12M, 12C, and 12K corresponding to Y, M, C, and K developers are arranged in the center of inside the printer 10. The developer is such that non-magnetic toner and a magnetic carrier are mixed together.

A transfer unit 14 is provided above the image forming units 12Y, 12M, 12C, and 12K. An imaging unit (image formation unit) 15 includes the image forming units 12Y, 12M, 12C, and 12K and the transfer unit 14.

The transfer unit 14 includes an intermediate transfer belt 16, first transfer rollers 18Y, 18M, 18C, and 18K, and a second transfer roller 20. The intermediate transfer belt 16 is an example of an intermediate transfer member. The first transfer rollers 18Y, 18M, 18C, and 18K that are of four first transfer members are arranged inside the intermediate transfer belt 16 to multiply transfer toner images of the image forming units 12Y, 12M, 12C, and 12K to the intermediate transfer belt 16. The second transfer roller 20 transfers the toner images superimposed on the intermediate transfer belt 16 to a recording sheet P.

The intermediate transfer belt 16 is entrained around a driving roller 26 and a tension roller 22 with a constant tension, and the intermediate transfer belt 16 is circularly driven in a direction (counterclockwise) of an arrow X of FIG. 1. The driving roller 26 is driven by a motor (not illustrated in the drawings) and is disposed to face the second transfer roller 20.

The first transfer rollers 18Y, 18M, 18C, and 18K are disposed to face photosensitive members 28 which will be described later (28Y, 28M, 28C, and 28K) of the image forming units 12Y, 12M, 12C, and 12K respectively with sandwiching the intermediate transfer belt 16 therebetween.

A transfer bias voltage having a polarity (for example, positive polarity in the exemplary embodiment) which is opposite a toner polarity is applied to the first transfer rollers 18Y, 18M, 18C, 18K. A transfer bias voltage having the polarity opposite the toner polarity is also applied to the second transfer roller 20.

At an outer circumferential surface of the intermediate transfer belt 16 in a position where the tension roller 22 is provided, a cleaning device 30 is provided. The cleaning device 30 includes a cleaning brush 32 and a cleaning blade 34 to remove residual toner or sheet dust on the intermediate transfer belt 16 by the cleaning brush 32 and the cleaning blade 34.

In the printer 10, a control unit 36 that controls driving of each portion of the printer 10 is provided near a side face on the side opposite a path for transporting the recording sheet P.

A sheet feeding cassette 46 in which the recording sheets P are stored is disposed below the image forming unit 12. A sheet transporting passage 50 through which the recording sheet P is transported is provided upwardly from an end part of the sheet feeding cassette 46 in the vertical direction.

A sheet feeding roller 48, a pair of sheet separating and transporting rollers 52, and sheet leading-end registration rollers 54 are provided in the sheet transporting passage 50. The sheet feeding roller 48 delivers the recording sheet P from the sheet feeding cassette 46. The pair of sheet separating and transporting rollers 52 feeds the recording sheet P one by one. The sheet leading-end registration rollers 54 matches arrival of the image on the intermediate transfer belt 16 and arrival of the recording sheet P such that the image is transferred to the recording sheet. The sheet feeding roller 48 sequentially delivers the recording sheet P from the sheet feeding cassette 46, and the recording sheet P is tentatively transported to a second transfer position of the intermediate transfer belt 16 by the sheet leading-end registration roller 54, which intermittently rotates, through the sheet transporting passage 50.

A fixing device 60 is provided above the second transfer roller 20. The fixing device 60 includes a heating roller 62 which is heated and a pressurizing roller 64 which is pressed against the heating roller 62. The recording sheet P to which the color toner images are transferred by the second transfer roller 20 is fixed in a press-contact portion between the heating roller 62 and the pressurizing roller 64 by the heat and pressure. Then a sheet discharge rollers 66 discharge the recording sheet P onto a discharge portion 68 which is disposed at an upper portion of the printer 10. The sheet discharge rollers 66 are of an example of a discharge device provided on the downstream side in the transporting direction of the recording sheet P. The cleaning device 30 removes the residual toner and sheet dust from the surface of the intermediate transfer belt 16 after the toner image second transfer process is performed.

(Image Forming Unit)

The image forming unit will be described below. The image forming unit 12M will be described by way of example. Because the other image forming units 12Y, 12C, and 12K corresponding to the respective colors have the same configurations as the image forming unit 12M, so the description is omitted. The suffix M is omitted in the components of the image forming unit 12M.

As illustrated in FIGS. 1 and 4 to 9, the image forming unit 12 includes a photosensitive unit 23 and a development unit 70 provided below the photosensitive unit 23.

A photosensitive member 28 which is driven to rotate in a direction (clockwise) of an arrow A is provided in the photosensitive unit 23. A charging roller 72, an LED print head 73, an erase lamp 74, and a cleaning portion 76 are provided around the photosensitive member 28. The charging roller 72 that is of an example of a charging device evenly charges the photosensitive member 28 while being in contact with the surface of the photosensitive member 28. The LED print head 73 irradiates the surface of the photosensitive member 28 with exposure light. The erase lamp 74 that is of an example of an erasing-charge device irradiates the surface of the photosensitive member 28 with light to erase charge after the transfer. The cleaning portion 76 cleans the surface of the photosensitive member 28 after the erasing of charge.

The charging roller 72, the LED print head 73, the development unit 70, the erase lamp 74, and the cleaning portion 76 are disposed in this order from the upstream side toward the downstream side in the rotating direction of the photosensitive member 28 while facing the surface of the photosensitive member 28.

In the outer circumferential surface of the charging roller 72, a cleaning roller 79 is rotatably provided at a side opposite the photosensitive member 28 to remove the toner and the like adhering to the surface of the charging roller 72. The charging roller 72 is connected to an energizing portion (not illustrated in the drawings), and energized when forming of the image, thereby charging the surface of the photosensitive member 28.

The development unit 70 develops an electrostatic latent image formed on the photosensitive member 28 by the exposure light with the corresponding color developer (toner). The development unit 70 includes a development chamber 82 and a stirring and conveying chamber 84. The stirring and conveying chamber 84 is provided below the development chamber 82 and stirs (mixes) the developer supplied from the toner cartridge 11 to convey the developer to the development chamber 82.

Figure 7:
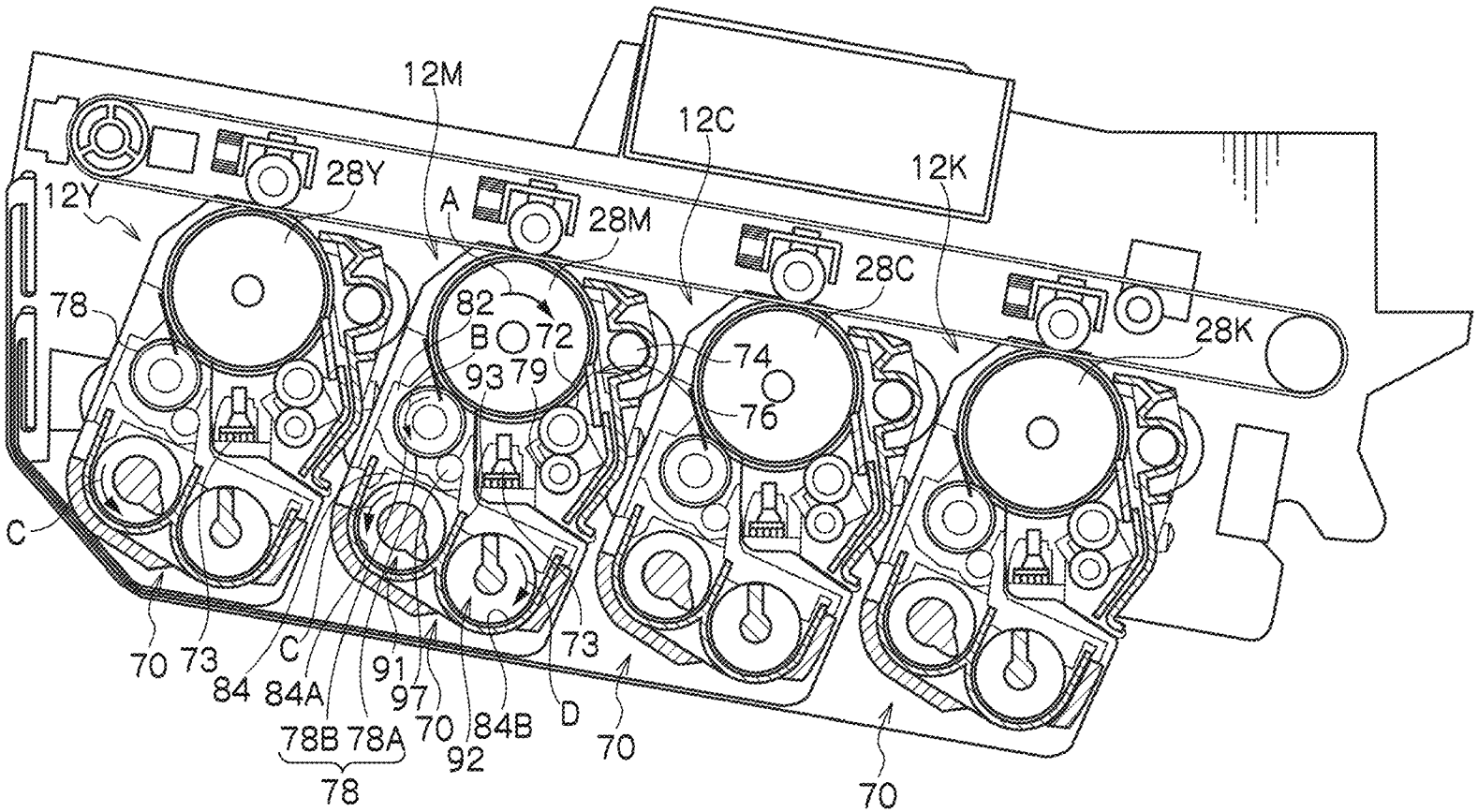
FIG. 7 is a front view illustrating a configuration of the image forming unit in the image forming apparatus of the exemplary embodiment.

As illustrated in FIG. 7, in the stirring and conveying chamber 84, it is partitioned into two stirring passages, that is, a first stirring passage 84A and a second stirring passage 84B by a partition wall 93 vertically provided from a bottom surface. An opened first connection port (not illustrated in the drawings) and an opened second connection port (not illustrated in the drawings) are formed at positions of both ends of the partition wall 93, and the first stirring passage 84A and the second stirring passage 84B are communicated with each other by the first connection port and the second connection port. A top surface of the second stirring passage 84B is opened and communicated with the development chamber 82.

Figure 10:
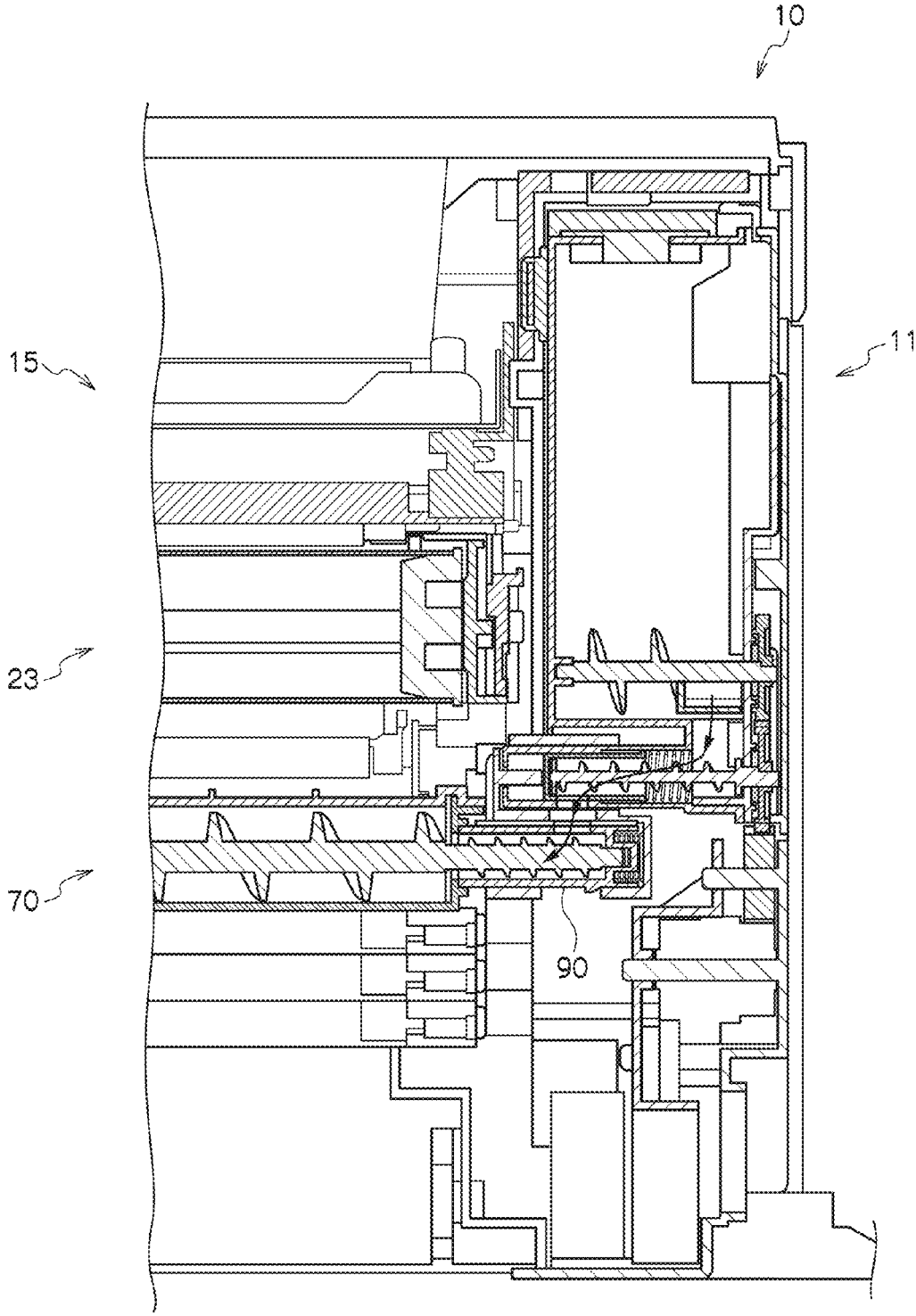
FIG. 10 is a side view illustrating a mounting mechanism of the toner cartridge in the image forming apparatus of the exemplary embodiment.
Figure 11:
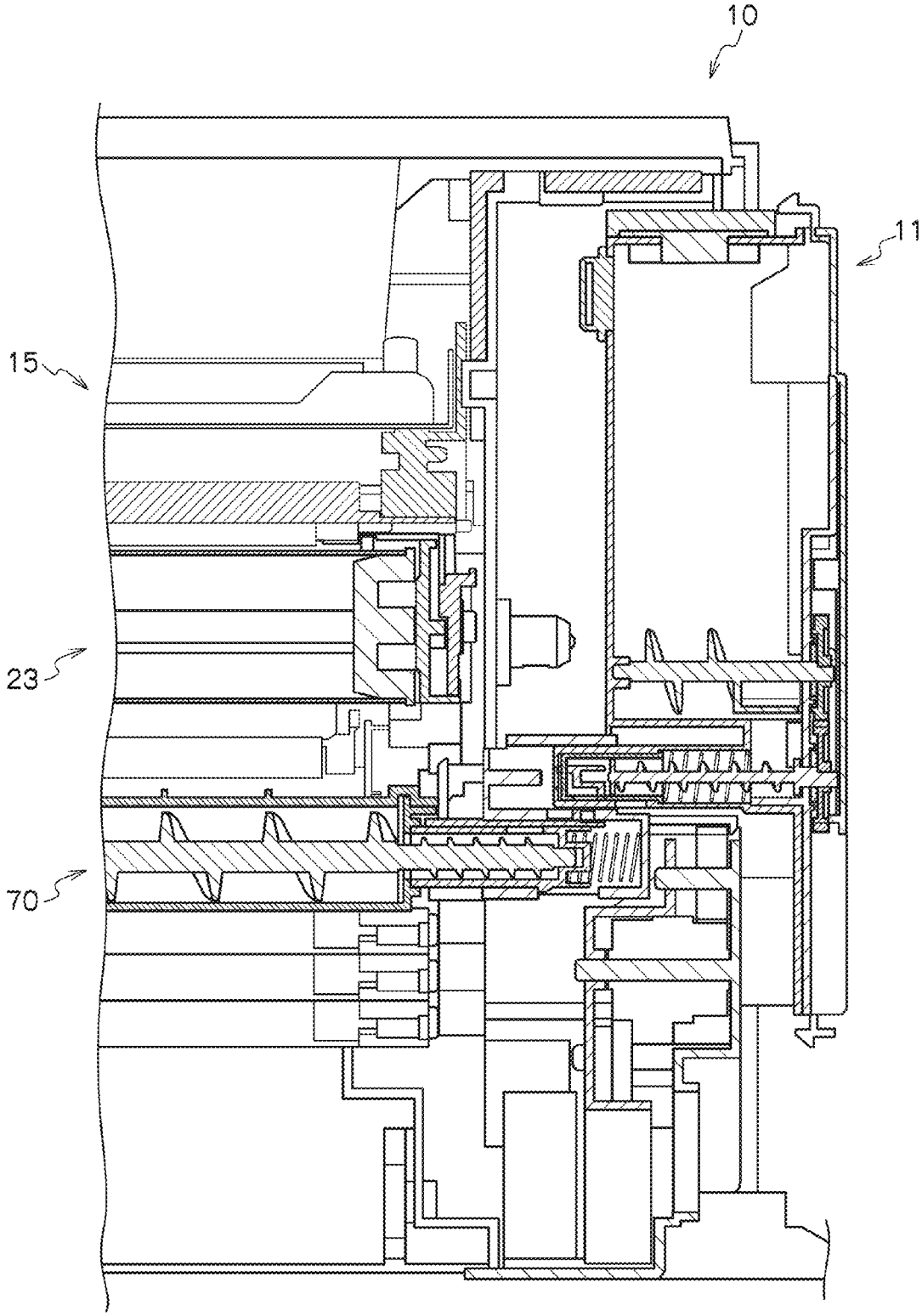
FIG. 11 is a side view illustrating the mounting mechanism of the toner cartridge in the image forming apparatus of the exemplary embodiment.

A projection 90 (see FIGS. 10 and 11) is formed at one end of the first stirring passage 84A so as to be projected outward further than an end face of the second stirring passage 84B. An opening through which the toner is supplied from the toner cartridge 11 is formed in a top surface of the projection 90.

A first stirring and conveying member 91 is disposed in the first stirring passage 84A. Similarly, a second stirring and conveying member 92 is disposed in the second stirring passage 84B.

The first and second stirring and conveying members 91 and 92 are driven by a driving unit including a motor (not illustrated in the drawings) and a gear (not illustrated in the drawings). By the rotation of the first stirring and conveying member 91 in a direction of an arrow C and the rotation of the second stirring and conveying member 92 in a direction of an arrow D (the directions of the arrows C and D differ from each other), the developer in the stirring and conveying chamber 84 is mixed with the supplied toner, conveyed in the first stirring passage 84A and second stirring passage 84B while stirred and mixed, and circulated between the first stirring passage 84A and the second stirring passage 84B.

As illustrated in FIG. 7, the development chamber 82 is communicated with the second stirring passage 84B. A development roller 78 is provided in the development chamber 82, and the development roller 78 is rotated in the direction (counterclockwise) of the arrow B about a longitudinal direction of the photosensitive member 28 as an axis direction. A thin-layer forming roller 97 that is of a layer regulating member is also provided in the development chamber 82. Alignment portions 78G are formed at both ends of the development roller 78. The Alignment portions 78G abut on the surface (circumferential surface) of the photosensitive member 28 to align the photosensitive member 28 and the development roller 78 (that is, to set a gap therebetween).

The thin-layer forming roller 97 is disposed on the upstream side of the photosensitive member 28 in the rotating direction of the development roller 78 while having a gap with the outer circumferential surface of the development roller 78. The thin-layer forming roller 97 regulates (controls) an amount of developer passing on the development roller 78 to form a developer layer (thin layer) having a predetermined thickness on the development roller 78.

The development roller 78 is disposed to face the outer circumferential surface of the photosensitive member 28 with an opening (not illustrated in the drawings) formed in the development chamber 82 therebetween. The development roller 78 is configured to include a magnet roller 78B and a development sleeve 78A. The magnet roller 78B that is of a magnetic-field generating portion is fixed to the development chamber 82. The development sleeve 78A that is of a cylindrical rotating body is formed into a hollow cylindrical shape, and the development sleeve 78A is provided rotatably around the outer portion of the magnet roller 78B. A bias voltage is applied between the development roller 78 and the photosensitive member 28 to form an electric field, thereby moving the toner in the developer toward the latent image on the photosensitive member 28 during the development.

(Structure of Imaging Unit)

A housing structure of the imaging unit 15 will mainly be described. In the following description, in a case where it is easer to explain of the housing structure by adding of suffixes Y, M, C, and K, the suffixes are added, and in a case where it is not necessary to add the suffixes when explaining, the suffixes are omitted.

Figure 4:
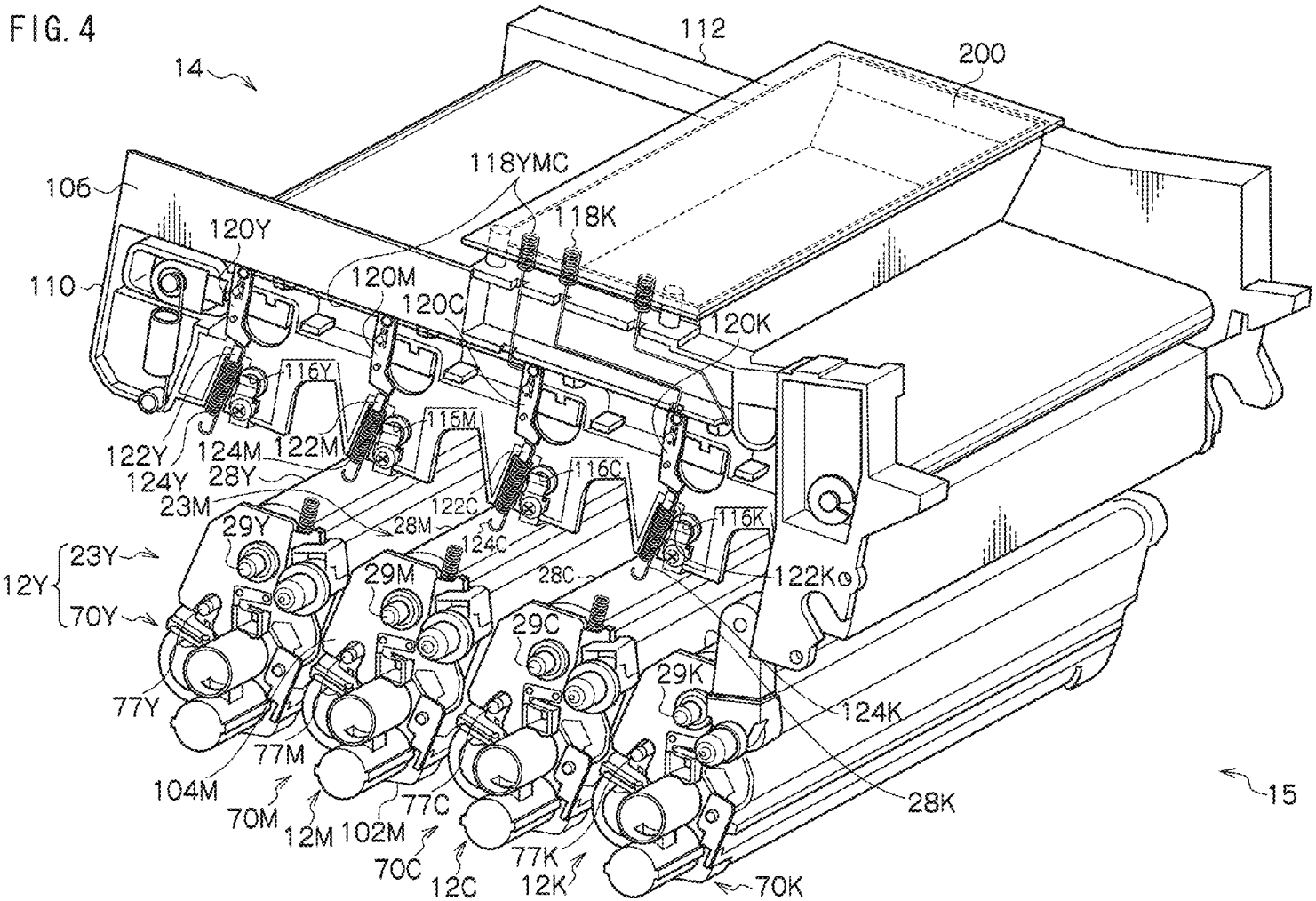
FIG. 4 is a development perspective view illustrating an image forming unit in the image forming apparatus of the exemplary embodiment.
Figure 5:
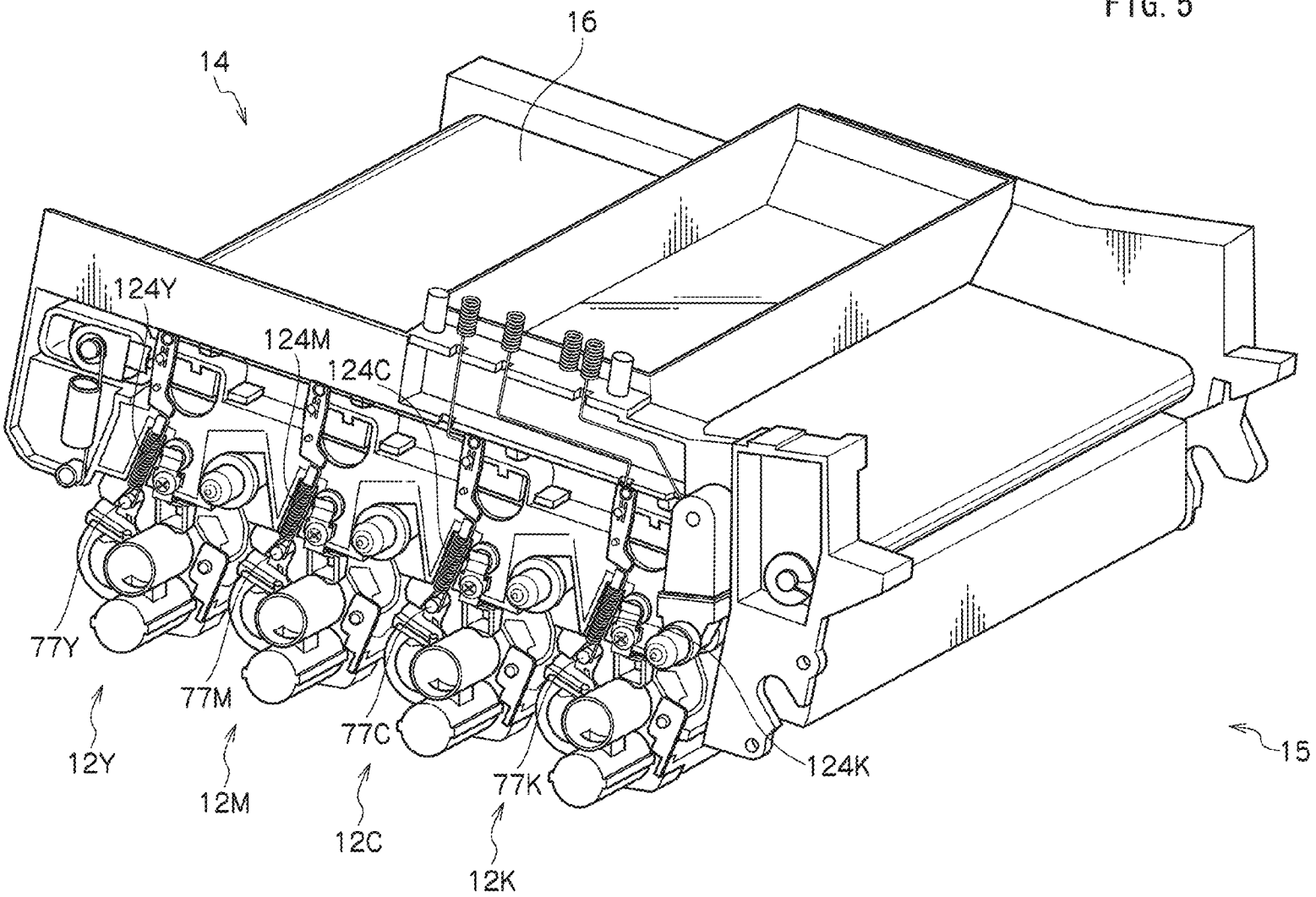
FIG. 5 is a perspective view illustrating the image forming unit in the image forming apparatus of the exemplary embodiment.
Figure 6:
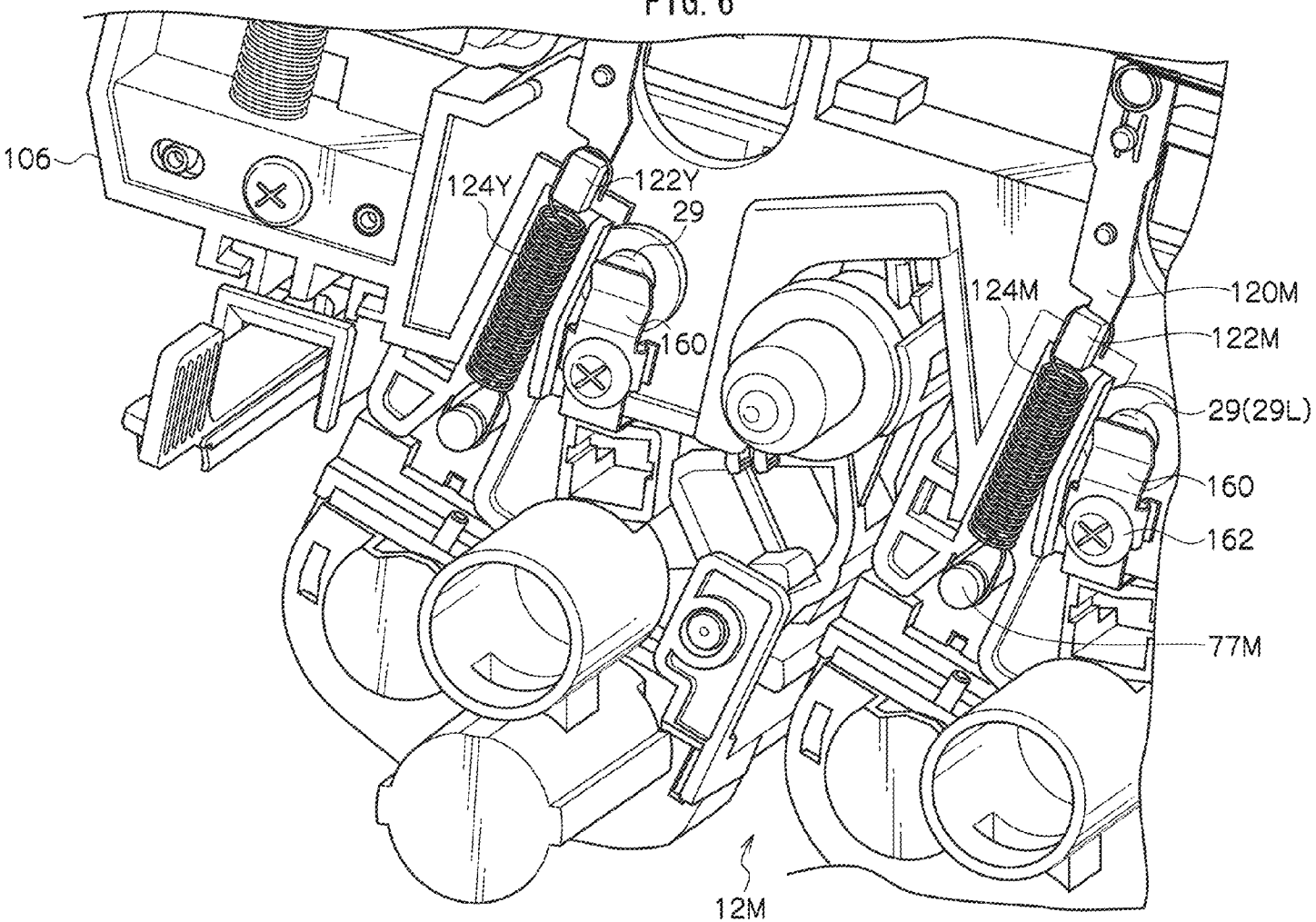
FIG. 6 is a partially enlarged view of the image forming unit of FIG. 5.

As described above, the imaging unit 15 is configured to include the image forming unit 12 and the transfer unit 14 located above the image forming unit 12 (see FIGS. 4 and 5). A housing of the image forming unit 12 is configured to include a lower housing (a development housing) 102 constituting the development unit 70 and an intermediate housing (a photosensitive body and LED print head housing) 104 constituting the photosensitive unit 23. A housing of the imaging unit 15 is configured to include an upper housing (a transfer housing) 106 constituting the transfer unit 14, the intermediate housings 104Y, 104M, 104C, and 104K, and lower housings 102Y, 102M, 102C, and 102K. The photosensitive members 28Y, 28M, 28C, and 28K are positioned (aligned) with the intermediate housings 104Y, 104M, 104C, and 104K, respectively. The upper housing 106, the intermediate housings 104Y, 104M, 104C, and 104K, and the lower housings 102Y, 102M, 102C, and 102K are made of a non-conductive material (resin).

The upper housing 106 includes a front surface portion 110 and a rear surface portion 112. The front surface portion 110 and rear surface portion 112 are formed on both end sides in a width direction of the intermediate transfer belt 16. Through holes 116Y, 116M, 116C, and 116K are formed in the front surface portion 110. Support shafts 29Y, 29M, 29C, and 29K of the photosensitive members 28Y, 28M, 28C, and 28K in the image forming units 12Y, 12M, 12C, and 12K pierce the through holes 116Y, 116M, 116C, and 116K.

A high-voltage power supply board 200 is provided on the top of the upper housing 106 to supply the bias voltage to the development units 70Y, 70M, 70C, and 70K. A power feeding wire 118YMC and a power feeding wire 118K are provided in the front surface portion 110 of the upper housing 106. The power feeding wire 118YMC is electrically connected to the high-voltage power supply board 200 to feed the electric power to each of the development units 70Y, 70M, and 70C. The power feeding wire 118K is electrically connected to the high-voltage power supply board 200 to feed the electric power to the development unit 70K. Conduction plates 120Y, 120M, 120C, and 120K are disposed in the front surface portion 110. The conduction plates 120Y, 120M, 120C, and 120K are respectively extended downward from upper positions of the development units 70Y, 70M, 70C, and 70K. The conduction plates 120Y, 120M, and 120C are electrically connected to the power feeding wire 118YMC, and the conduction plate 120K is electrically connected to the power feeding wire 118K.

Hook portions 122Y, 122M, 122C, and 122K (also see FIG. 14) are formed in lower end positions of the conduction plates 120Y, 120M, 120C, and 120K. Helical tension springs 124Y, 124M, 124C, and 124K are provided in the imaging unit 15. The helical tension springs 124Y, 124M, 124C, and 124K are latched in the ends of the support shafts 77Y, 77M, 77C, and 77K of the development rollers 78Y, 78M, 78C, and 78K and the hook portions 122Y, 122M, 122C, and 122K.

When the upper ends of the helical tension springs 124Y, 124M, 124C, and 124K are latched in the hook portions 122Y, 122M, 122C, and 122K, the transfer unit 14, the photosensitive unit 23, and the development unit 70 are assembled to form the imaging unit 15. Further, the lower ends of the conduction plates 120Y, 120M, 120C, and 120K and the upper ends of the helical tension springs 124Y, 124M, 124C, and 124K are put into electric conduction, whereby the helical tension spring 124 forms a power feeding path.

Figure 14:
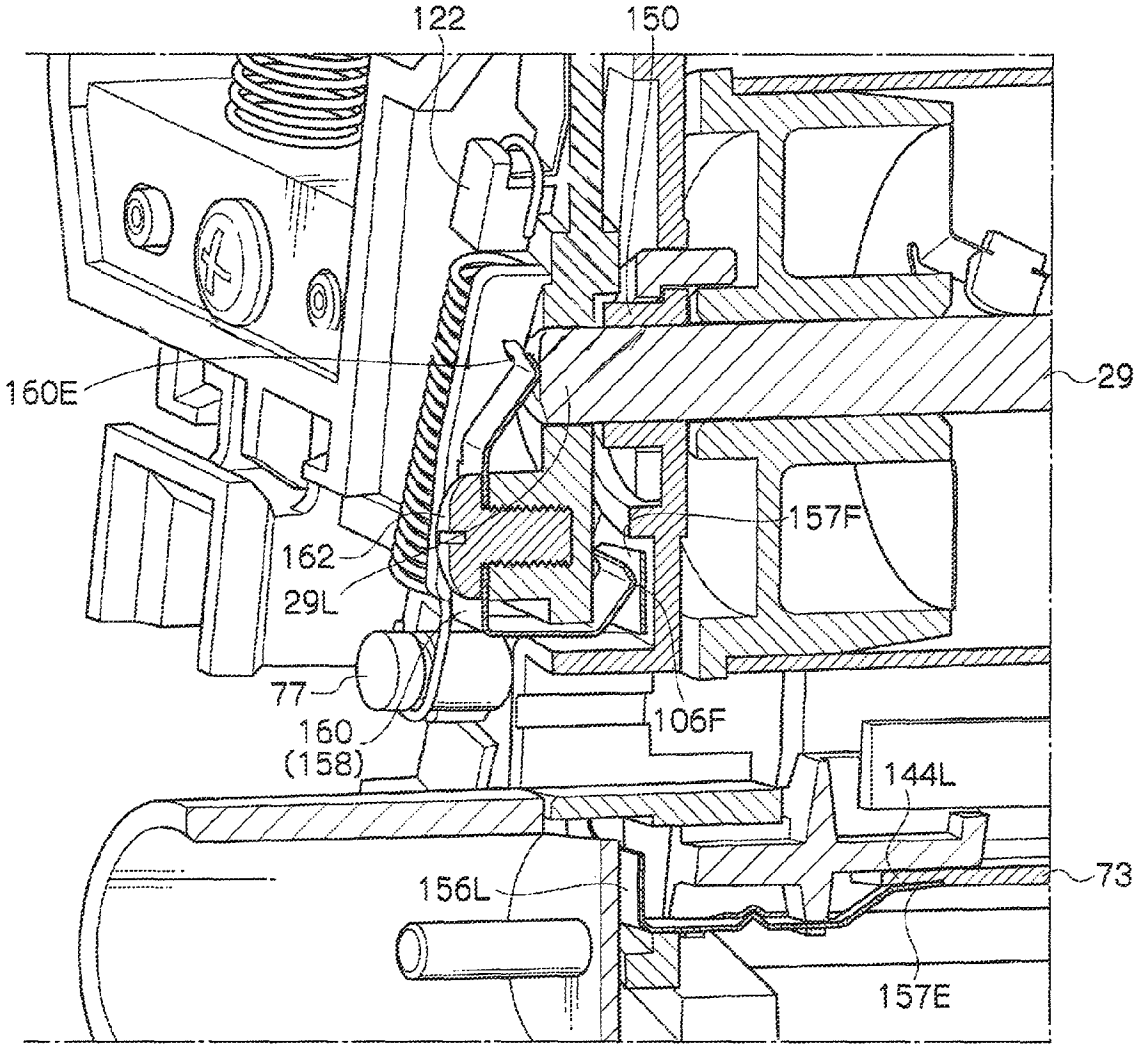
FIG. 14 is a partially enlarged perspective view illustrating the image forming apparatus of the exemplary embodiment.
Figure 15:
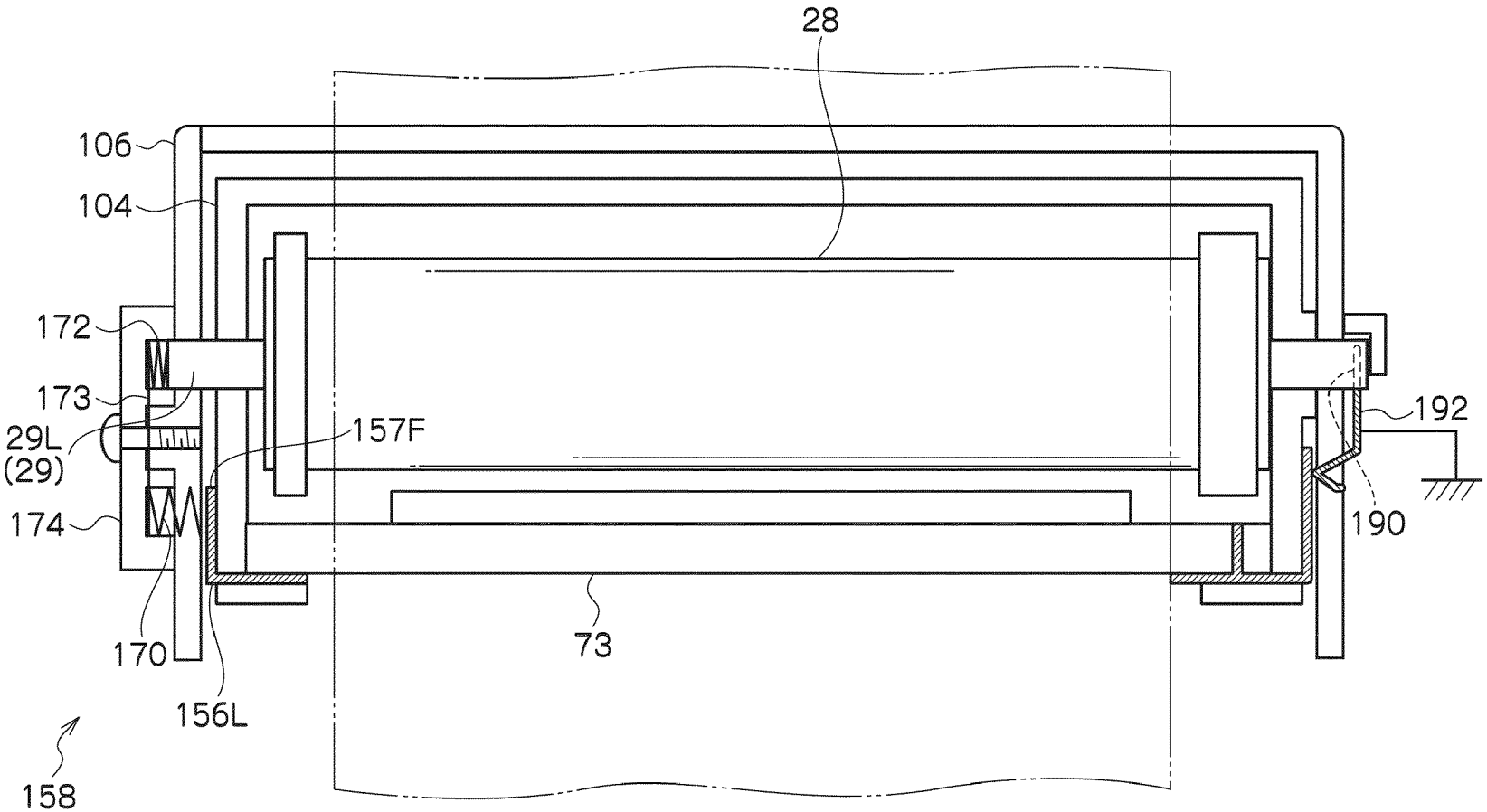
FIG. 15 is an explanatory view illustrating a configuration of electric conduction and ground of an LED print head in an image forming apparatus according to a modification of the invention.

In FIGS. 14 and 15, the hook portions 122Y, 122M, 122C, and 122K and the helical tension springs 124Y, 124M, 124C, and 124K are provided on the front surface side of the imaging unit 15. However, the hook portions 122Y, 122M, 122C, and 122K and the helical tension springs 124Y, 124M, 124C, and 124K are also provided on the rear surface side of the imaging unit 15.

Figure 8:
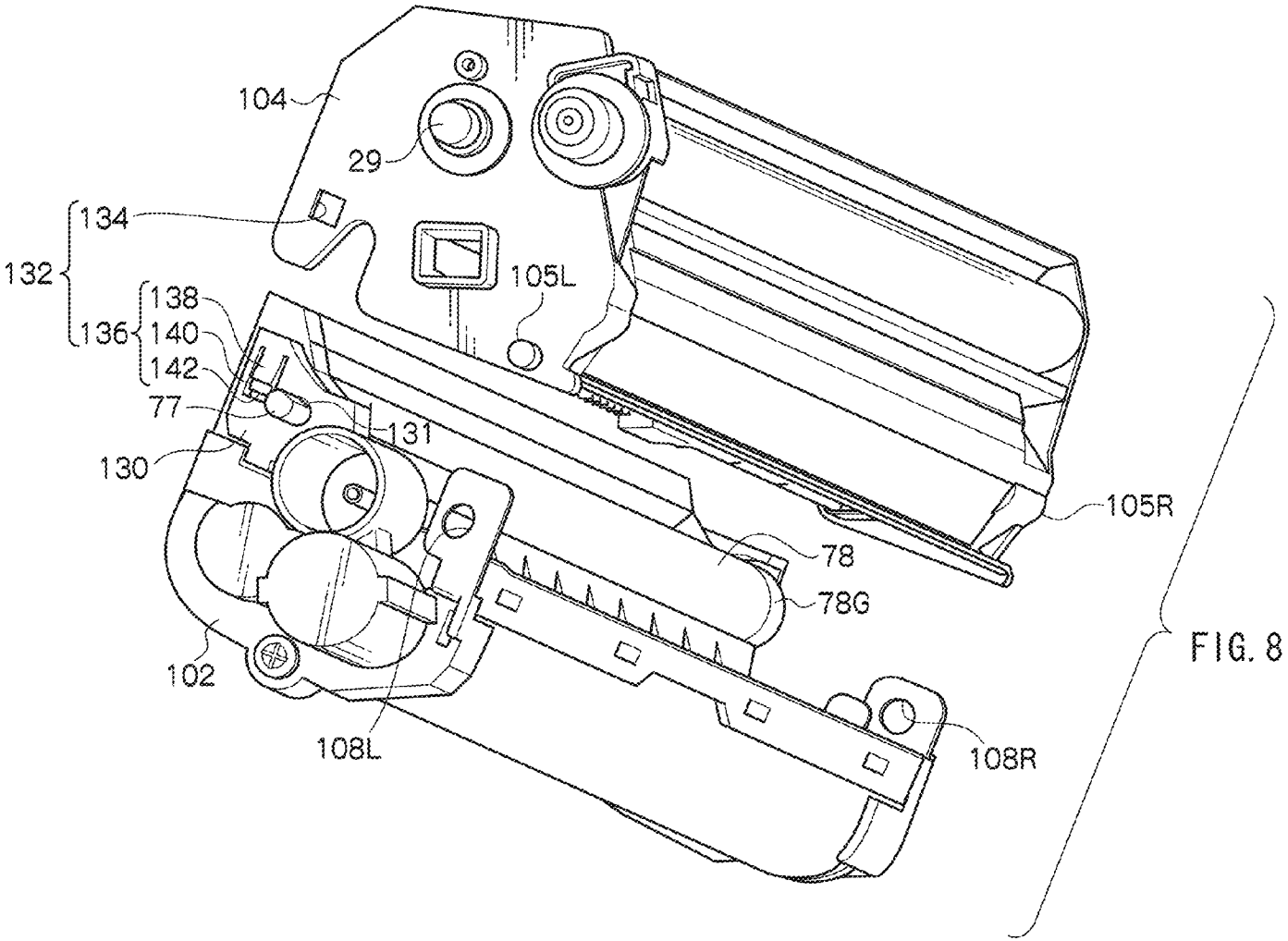
FIG. 8 is a development perspective view explaining an assembly configuration of the image forming unit in the image forming apparatus of the exemplary embodiment.
Figure 9:
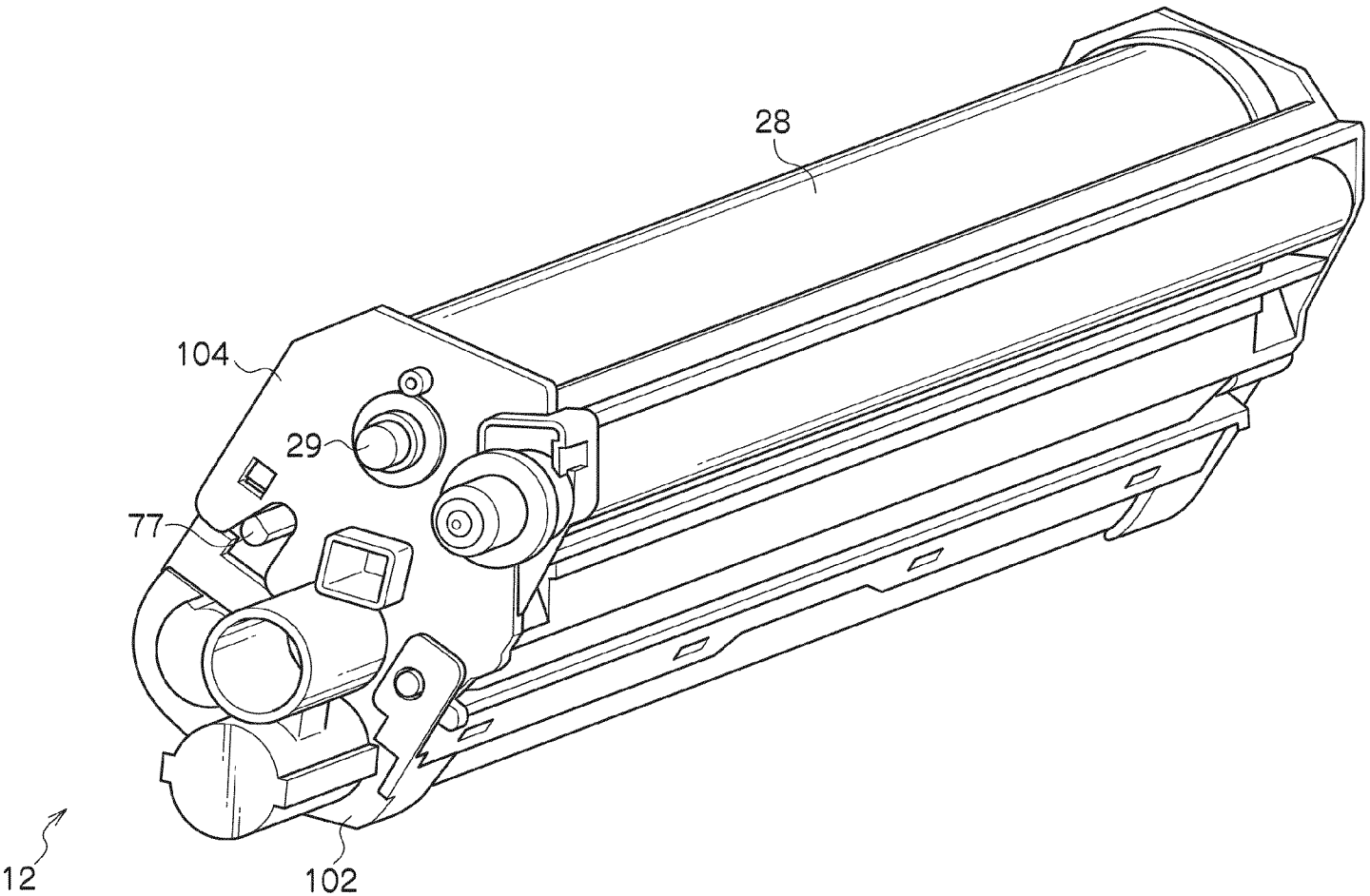
FIG. 9 is a perspective view explaining an assembly configuration of the image forming unit in the image forming apparatus of the exemplary embodiment.

As illustrated in FIGS. 8 and 9, the support shaft 77 of the development roller 78 has a conductive property, and both ends of the support shaft 77 are each supported by a round hole 131 of a development roller support plate 130 constituting the development unit 70. The development roller 78 and the hook 122 receive a tensile force (urging force) while being coupled by the helical tension spring 124, thereby aligning respectively the development rollers 78Y, 78M, 78C, and 78K of the image forming units 12Y, 12M, 12C, and 12K with respect to the imaging unit 15.

A temporarily-jointing latch structure 132 is formed by the development roller support plates 130 and the intermediate housing 104. That is, a latching opening 134 is formed in the intermediate housing 104, and an overhang plate 136 is formed in the development roller support plate 130. The overhang plate 136 is latched in the opening 134. The overhang plate 136 includes an overhang upper part 138 and an overhang lower part 140. The overhang upper part 138 is gradually overhung toward the outside in the longitudinal direction of the support shaft of the development roller 78 from a top portion to a bottom portion. The overhang lower part 140 is continuously connected to the lower end of the overhang upper part 138 and extended downward from a position inside the overhang upper part 138 in the longitudinal direction of the support shaft. Accordingly, a step 142 is formed at a boundary between the overhang upper part 138 and the overhang lower part 140. Coupling shafts 105 (105R and 105L) are provided at both ends in the longitudinal direction in the intermediate housing 104. Coupling holes 108 (108R and 108L) are formed at both ends in the longitudinal direction in the lower housing 102. The coupling shafts 105 are fitted in the coupling holes 108.

(LED Print head and Grounding Structure Thereof)

The LED print head 73 and the grounding (earthing) structure of the LED print head 73 will be described below. As illustrated in FIGS. 12 to 19, in the image forming unit 12, the LED print head 73 (hereinafter referred to as LPH 73) is provided in parallel with the photosensitive member 28. LPH 73 is supported by the intermediate housing 104.

Figure 19:
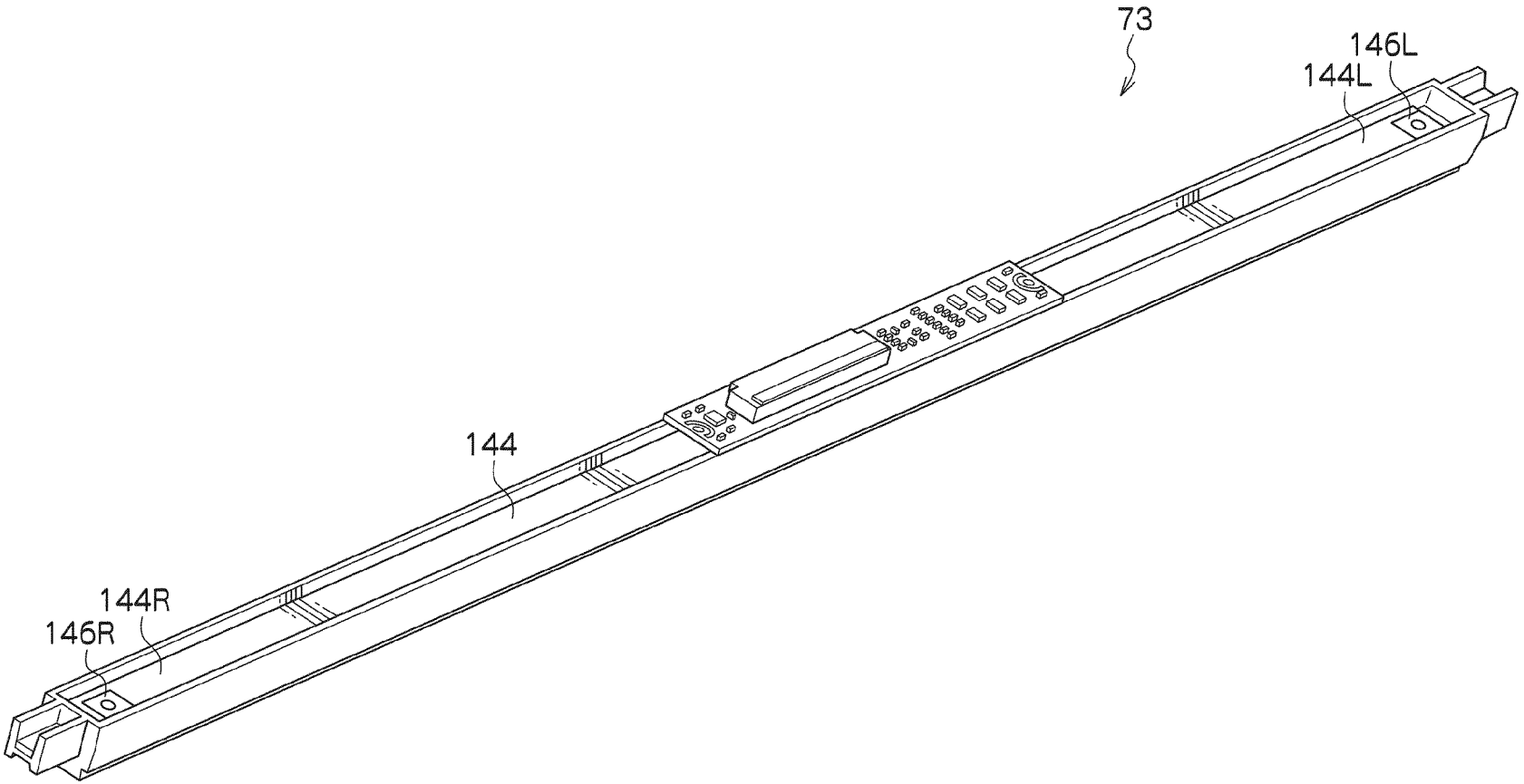
FIG. 19 is a perspective view illustrating the LED print head constituting the image forming apparatus of the exemplary embodiment.

As illustrated in FIG. 19, the LPH 73 has a long and narrow shape, a ground terminal 146L is provided in one longitudinal end portion 144L of a board 144 of the LPH 73, and a ground terminal 146R is provided in another longitudinal end portion 144R of the board 144. The one longitudinal end portion 144L is adjacent to one end (support-shaft one end portion 29L which will be described later) of the support shaft 29, and the other longitudinal end portion 144R is adjacent to another end (support-shaft another end portion 29R which will be described later) of the support shaft 29 (see FIG. 12 and the like).

Figure 12:
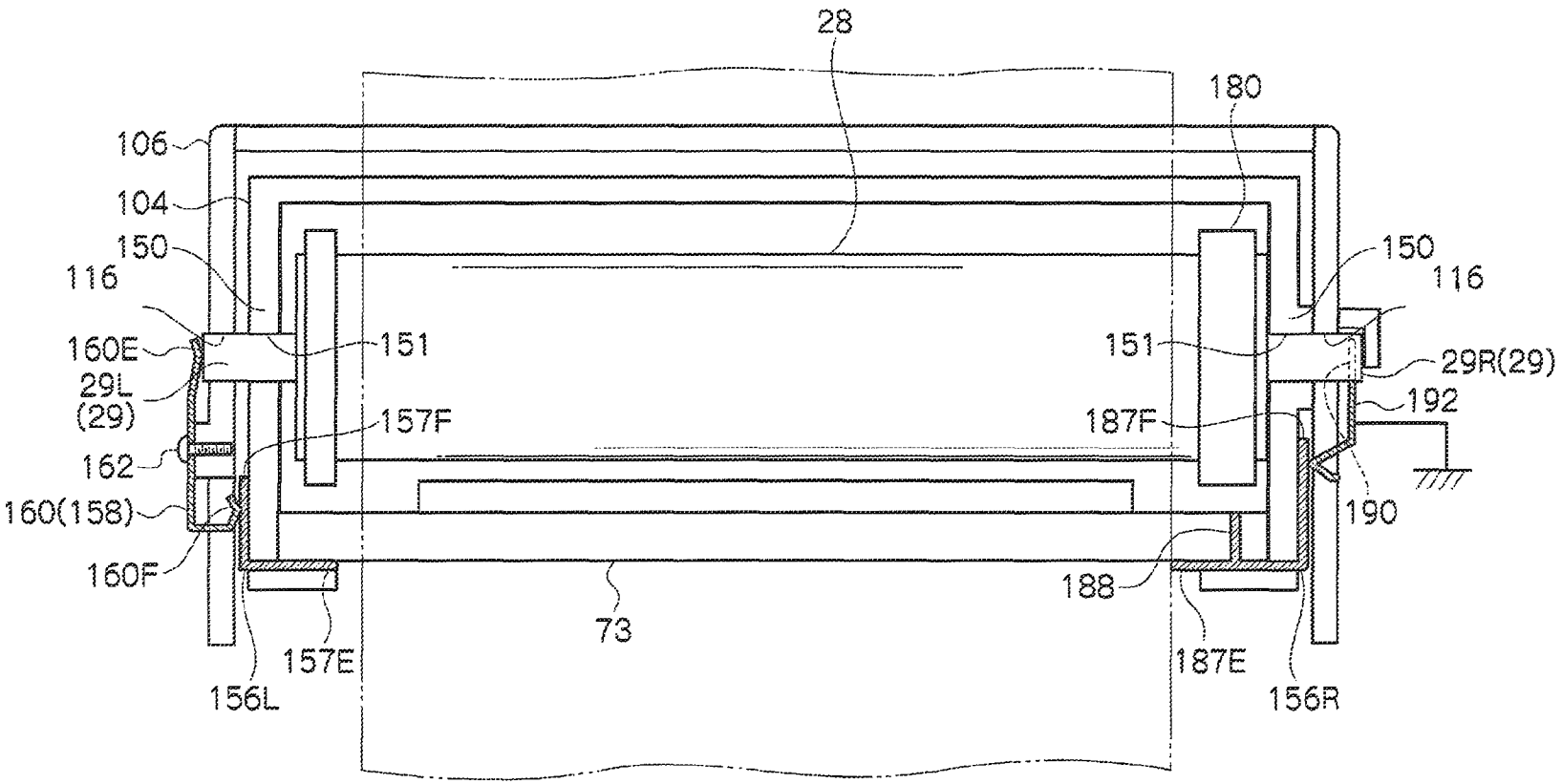
FIG. 12 is an explanatory view illustrating a configuration of electric conduction and ground of an LED print head in the image forming apparatus of the exemplary embodiment.

A support portion 150 is formed in the intermediate housing 104 to rotatably support the support shaft 29 (an example of a long member) of the photosensitive member 28 (see FIGS. 12 and 14). At one end side of the support shaft 29, a through hole 151 is formed in the support portion 150, and the support shaft 29 pierces the through hole 151. An insertion hole 107L is formed in the upper housing 106, and the support-shaft one end portion 29L projected from the through hole 151 is inserted in the insertion hole 107L. Accordingly, the support-shaft one end portion 29L is projected toward the outside of the upper housing 106.

As illustrated in FIGS. 12 and 14, in the imaging unit 15, a plate spring member 156L is provided as a connection terminal near the support-shaft one end portion 29L, and the plate spring member 156L has a substantial L-shape as viewed from the front. A one end portion 157E of the plate spring member 156L has a shape such that it presses the ground terminal 146L while abutting on the ground terminal 146L. Another end portion 157F of the plate spring member 156L is extended to the neighborhood of the support-shaft one end portion 29L of the photosensitive member 28 and exposed to the outside of the intermediate housing 104.

Figure 13:
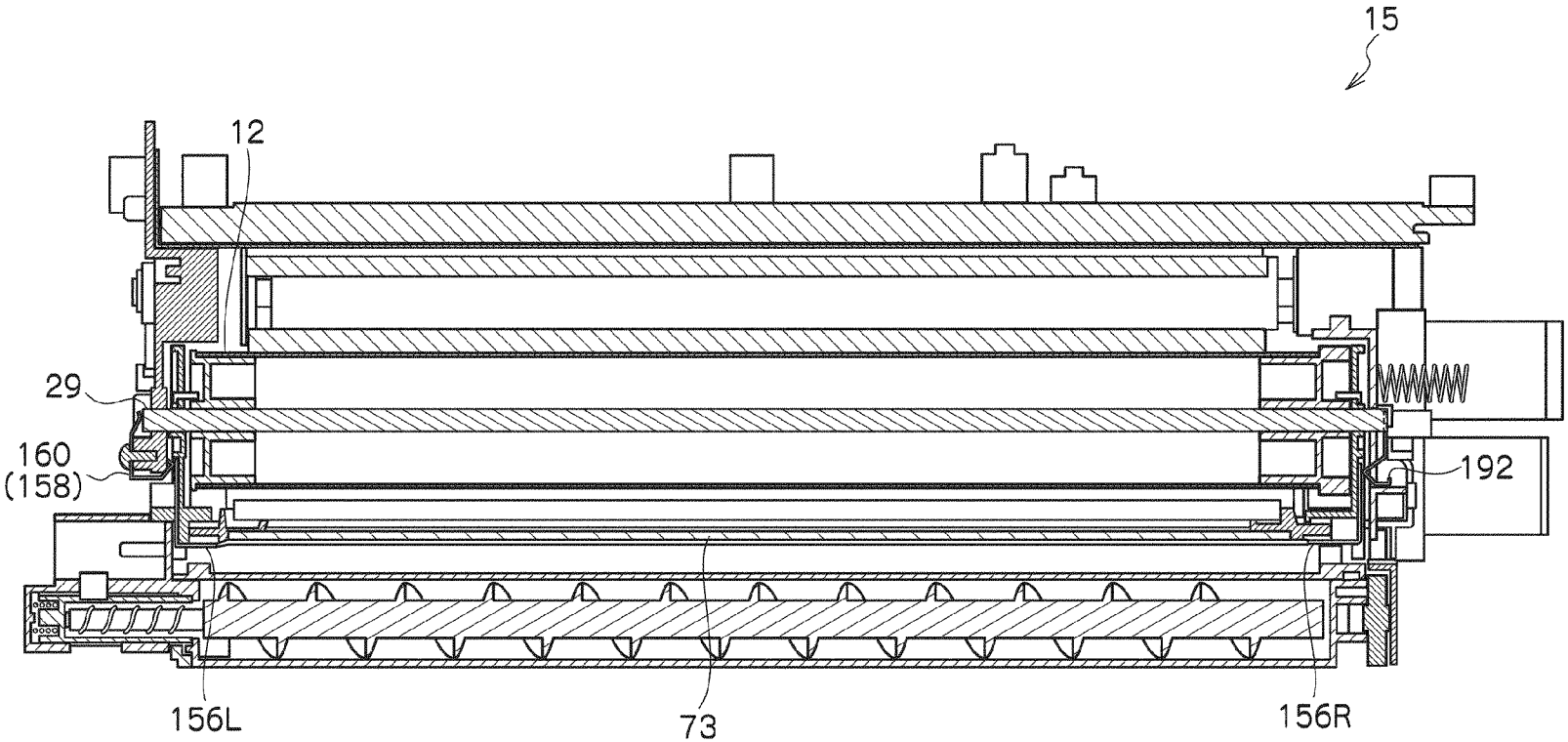
FIG. 13 is a front sectional view illustrating the imaging unit in the image forming apparatus of the exemplary embodiment.

A conduction portion 158 is provided in the imaging unit 15 to establish the conduction state between the support-shaft one end portion 29L of the photosensitive member 28 and the other end portion 157F of the plate spring member 156L. As illustrated in FIGS. 12 to 14, the conduction portion 158 is configured to be a plate spring member 160 having a substantial U-shape. At this point, for example, the plate spring member 160 is shaped such that one end portion 160E abuts on the support-shaft one end portion 29L of the photosensitive member 28 so as to press the support-shaft one end portion 29L from the axial direction, and another end portion 160F abuts on the other end portion 157F of the plate spring member 156L so as to press the other end portion 157F. The plate spring member 160 is engaged in the upper housing 106 by a bolt 162 between the one end portion 160E and the other end portion 160F.

As illustrated in FIG. 15, the conduction portion 158 may be configured to include a conductive helical compression spring 170, a conductive helical compression spring 172, a conduction member 173, and a cap member 174. The helical compression spring 170 urges the other end portion 157F while abutting on the other end portion 157F that is the upper end portion of the plate spring member 156L. The helical compression spring 172 urges the support-shaft one end portion 29L while abutting on the support-shaft one end portion 29L from the axial direction. The conduction member 173 is connected to the helical compression springs 170 and 172 to put the helical compression springs 170 and 172 into electric conduction. The cap member 174 presses an end portion of the helical compression spring 172 on the side opposite from the support shaft 29 and an end portion of the helical compression spring 170 on the side opposite from the plate spring member 156L.

Irrespective of the configuration of the conduction portion 158, the support-shaft one end portion 29L of the photosensitive member 28 and the ground terminal 146L provided in the longitudinal one end portion 144L of the board 144 of LPH 73 are put into electric conduction by the conduction portion 158.

Figure 16:
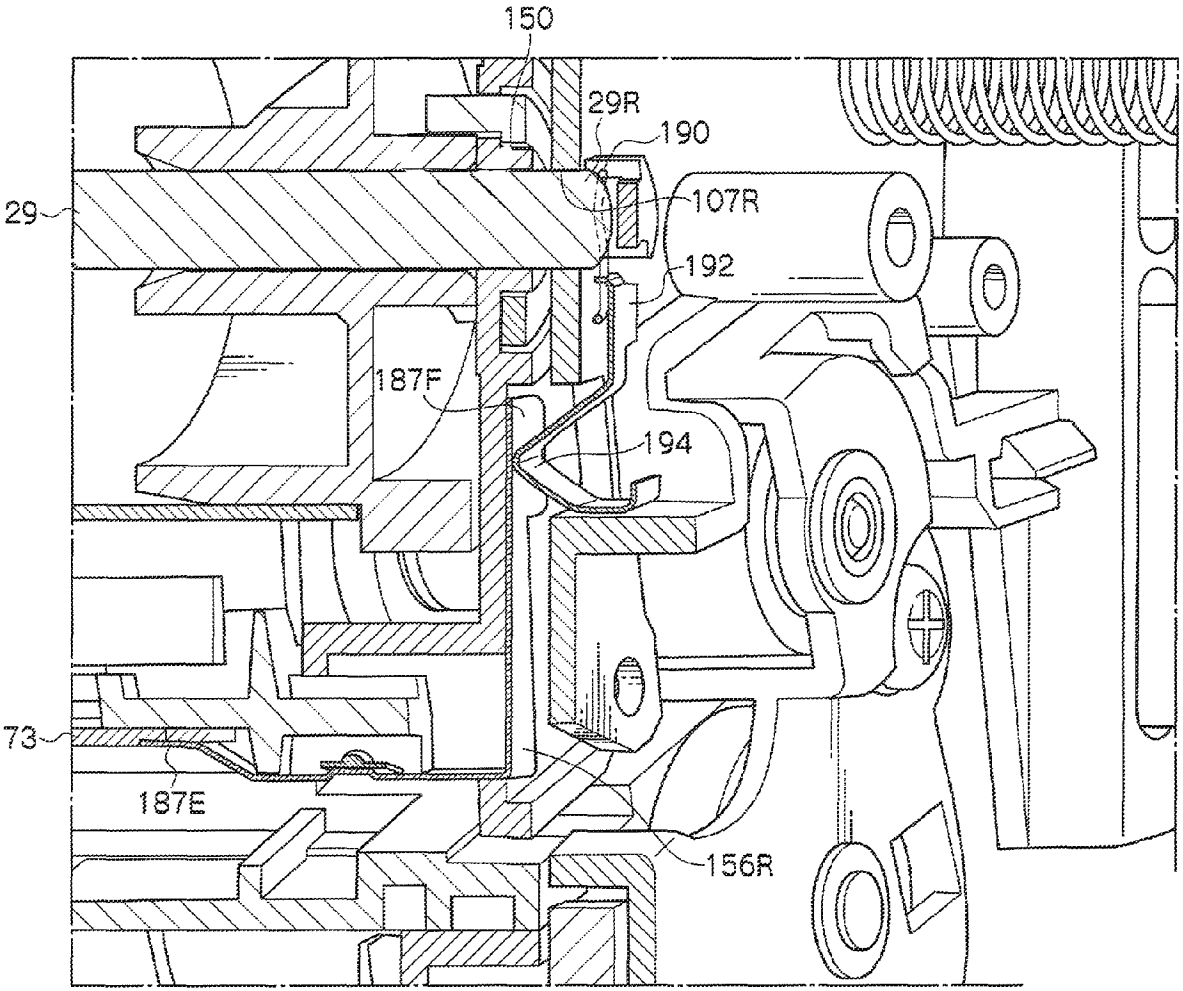
FIG. 16 is a partially enlarged perspective view illustrating the image forming apparatus of the exemplary embodiment.

As illustrated in FIGS. 12 and 16, the through hole 151 is formed in the support portion 150 on the other end side of the support shaft 29 of the photosensitive member 28, and the support shaft 29 pierces the through hole 151. An insertion hole 107R is formed in the upper housing 106, and the support-shaft other end portion 29R projected from the through hole 151 is inserted in the insertion hole 107R. Accordingly, the support-shaft other end portion 29R is projected toward the outside of the upper housing 106. A gear 180 which the torque is transmitted is provided on the other end side of the support shaft 29.

In the imaging unit 15, a plate spring member 156R is provided as a connection terminal near the support-shaft other end portion 29R, and the plate spring member 156R has a substantial L-shape as viewed from the front. One end portion 187E of the plate spring member 156R is shaped so as to press the ground terminal 146R while abutting on the ground terminal 146R. An end portion 187F of the plate spring member 156R is shaped so as to extend to the neighborhood of the support-shaft other end portion 29R of the photosensitive member 28 and be exposed to the outside of the intermediate housing 104.

In the plate spring member 156R, an engage portion 188 which is engaged in the LPH 73 is formed in the center of the plate spring member along the longitudinal direction of the LPH 73. The end portion of the LPH 73 is pressed against an inner wall of the intermediate housing 104 and aligned such that it is sandwiched between the latch portion 188 of the plate spring member 156R and the other end portion 187F of the plate spring member 156R.

As illustrated in FIG. 16, a wire-spring shape spring ground 190 and a plate ground 192 are provided in the imaging unit 15. The spring ground 190 urges the support-shaft other end portion 29R so as to press the support-shaft other end portion 29R from the axial direction. An upper end portion of the plate ground 192 is connected to the spring ground 190. The plate ground 192 is formed into a plate-spring shape, and the plate ground 192 includes a bent portion 194 that abuts on the other end portion 187F of the plate spring member 156R to press the other end portion 187F. The spring ground 190 is connected to an apparatus ground (not illustrated in the drawings) which is general of the printer 10.

Accordingly, in the exemplary embodiment, not only the ground terminal 146L provided in the longitudinal one end portion 144L of the LPH 73 but also the ground terminal 146R provided in the longitudinal other end portion 144R of the LPH 73 are grounded.

Figure 17:
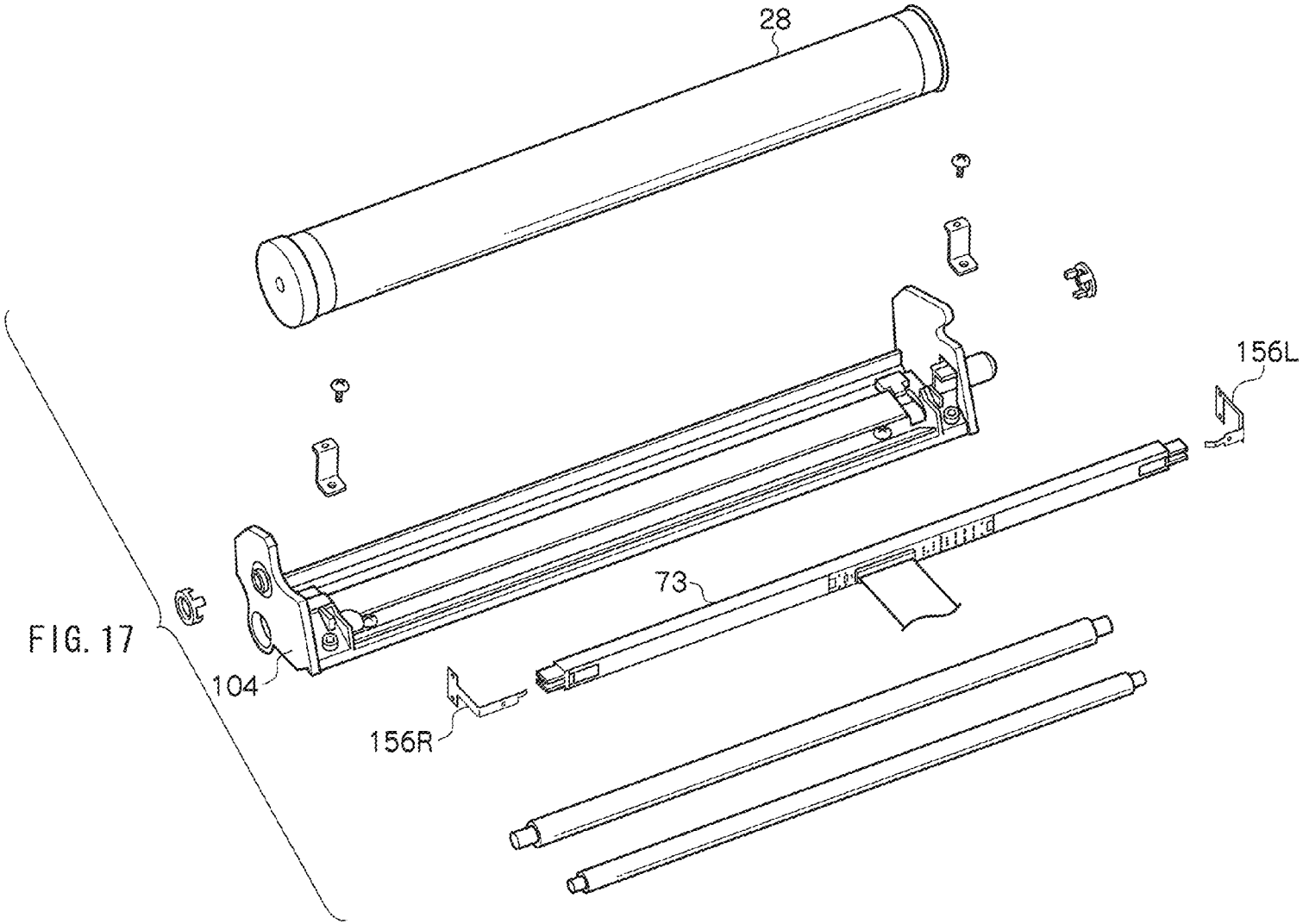
FIG. 17 is a development perspective view illustrating a photosensitive unit constituting the image forming apparatus of the exemplary embodiment.
Figure 18:
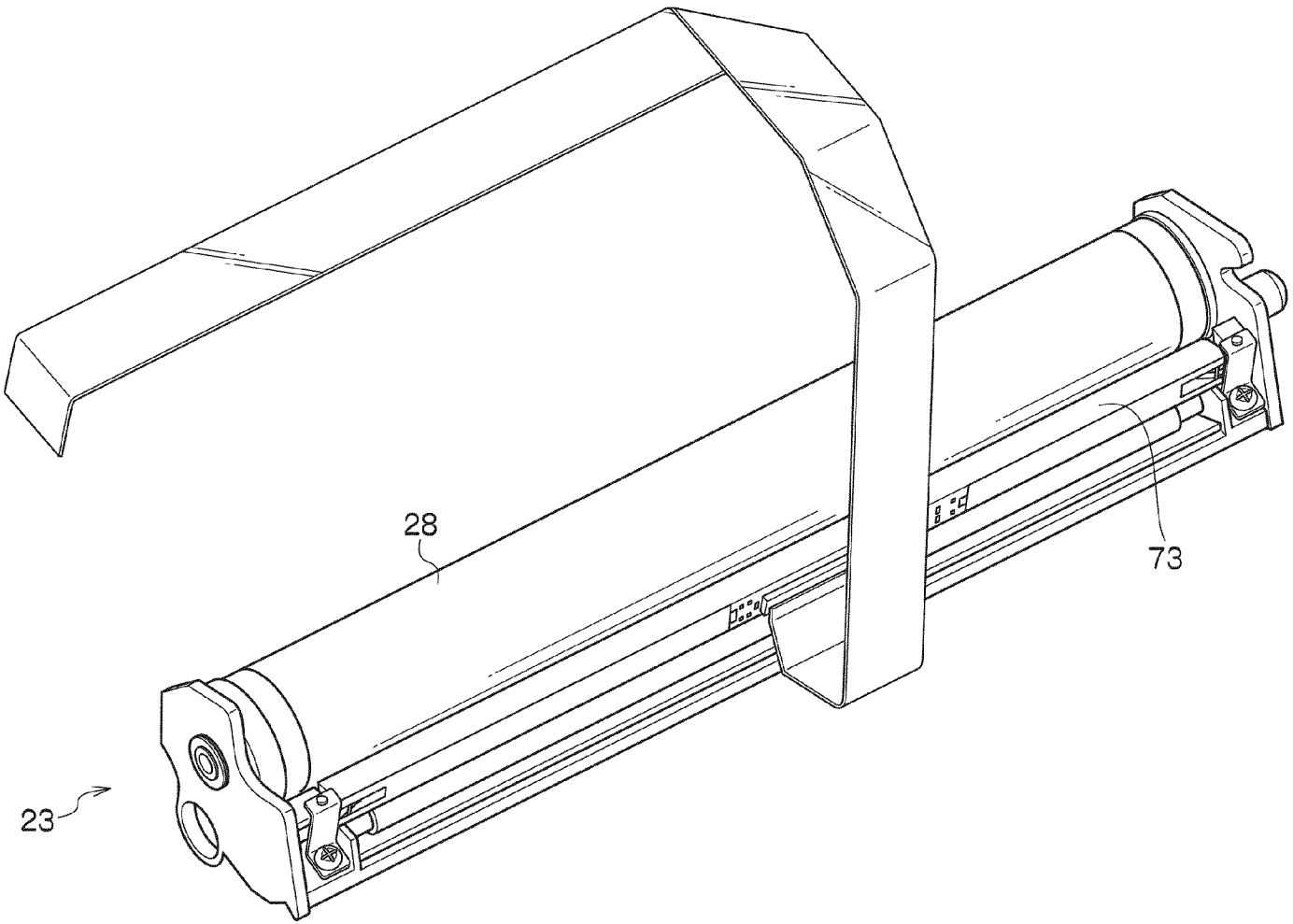
FIG. 18 is a perspective view illustrating the photosensitive unit constituting the image forming apparatus of the exemplary embodiment.

In FIGS. 12 and 17, although the horizontal positions (left and right) of the ground terminals 146L and 146R look inverted, this is generated by a difference in illustrated angle, so that it is not conflicted.

An image forming process of the printer 10 will be described below.

As illustrated in FIG. 1, the image data to which the image processing device (not illustrated in the drawings) performs the image processing is converted into pieces of gradation data of yellow (Y), magenta (M), cyan (C), and black (K) colors. The exposure light is emitted according to each gradation data to perform scanning exposure to each photosensitive member 28, thereby forming the electrostatic latent images.

As illustrated in FIG. 1, the development unit 70 develops the electrostatic latent image formed on the photosensitive member 28, and each electrostatic latent image is visualized as the yellow (Y), magenta (M), cyan (C), and black (K) toner images (developer images). The respective toner images sequentially formed on the photosensitive members 28 of the image forming units 12Y, 12M, 12C, and 12K are multiply transferred onto the intermediate transfer belt 16 by the four first transfer rollers 18Y, 18M, 18C, and 18K.

The yellow (Y), magenta (M), cyan (C), and black (K) toner images multiply transferred onto the intermediate transfer belt 16 are second transferred onto the transported recording sheet P by the second transfer roller 20. The fixing device 60 fixes the yellow (Y), magenta (M), cyan (C), and black (K) toner images onto the recording sheet P, and the recording sheet P is discharged to the discharge tray 68.

After the toner image transfer process, the cleaning portion 76 removes the residual toner and sheet dust from the surface of the photosensitive member 28. The cleaning device 30 removes the residual toner and sheet dust from the surface of the intermediate transfer belt 16.

An operation and effect of the exemplary embodiment will be described below.

In manufacturing the imaging unit 15, lifetimes of main components such as the photosensitive members 28Y, 28M, 28C, and 28K and the development units 70Y, 70M, 70C, 70K are substantially matched with a lifetime of the main body of the printer 10 such that periodic component replacement is eliminated. For example, specifications are determined such that the main components and image forming apparatus main body reach the lifetimes (run down) when printing is performed with 50000 sheets. It is configured that components are replaceable on the assumption that the component needs to be non-periodic repaired (for example, in a case where the component is mistakenly damaged).

Figure 20:
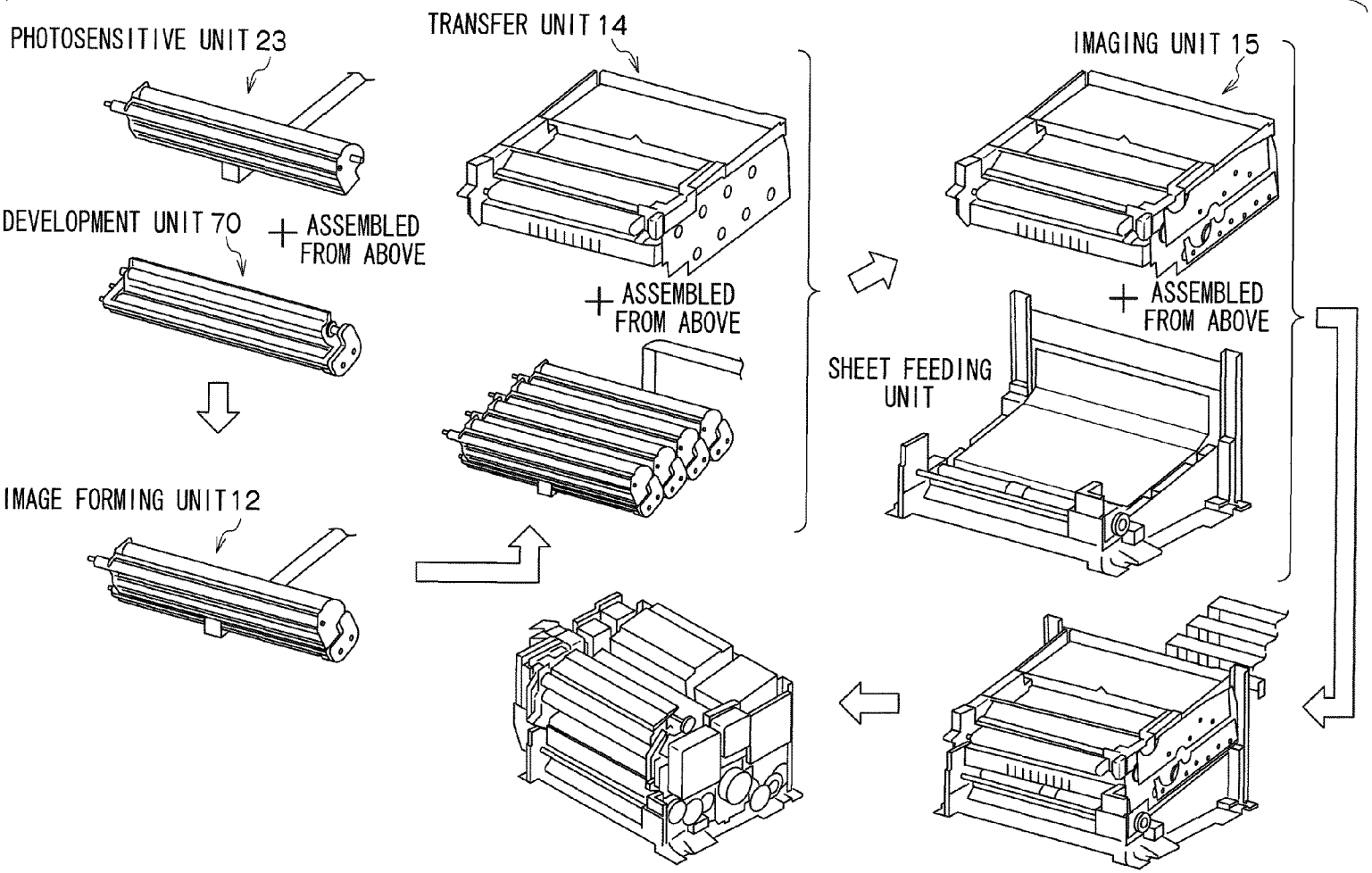
FIG. 20 is an explanatory view illustrating a process for producing the image forming apparatus of the exemplary embodiment.

The imaging unit 15 is assembled in a procedure of FIG. 20 using the components whose specifications are determined in the above-described manner. That is, the photosensitive unit 23 except for the support shaft 29 of the photosensitive member 28 and the development unit 70 are coupled by the coupling shaft 105 (that is, 105R and 105L) and the coupling hole 108 (that is, 108R and 108L) and thereafter, tentatively jointed by using the latch structure 132. The transfer unit 14 is assembled in the image forming unit 12 from above, the support shaft 29 of the photosensitive member 28 is inserted in the photosensitive member 28, the through holes 151 of the intermediate housing 104, and the through holes 116 of the upper housing 106. After the imaging unit 15 is assembled, it is assembled to a sheet feeding unit.

In assembling the imaging unit 15, the helical tension springs 124Y, 124M, 124C, and 124K are latched in the support shafts 77Y, 77M, 77C, and 77K of the development rollers 78Y, 78M, 78C, and 78K and the hooks 122Y, 122M, 122C, and 122K. As a result, the imaging unit 15 in which the photosensitive unit 23 is sandwiched between the development unit 70 and the transfer unit 14 by the urging force of the helical tension springs 124 is formed, further, the development rollers 78Y, 78M, 78C, and 78K are aligned with respect to the photosensitive members 28Y, 28M, 28C, and 28K at the same time as the development units 70Y, 70M, 70C, and 70K are retained by the upper housing 106. Accordingly, the imaging unit 15 having the extremely good assembly productivity and the simple structure are assembled. The apparatus structure is simplified because the helical tension spring 124 is used as an elastic body.

The support shaft 29 of each of the photosensitive members pierces the upper housing 106. Therefore, positional accuracy between the photosensitive members 28 and the upper housing 106 is maintained in the good state to improve pitch accuracy between the photosensitive members.

The helical tension spring 124 urges the development unit 70 toward the transfer unit 14, whereby the development roller 78 is rotatably supported by the intermediate housing 104 supporting the photosensitive member 28. Accordingly, relative positional relationship between the photosensitive member 28 and the development roller 78 is determined with high accuracy.

The helical compression spring 124 puts the conductive plate 120 and the support shaft 77 of the development roller 78 into electric conduction. Therefore, because the helical compression spring 124 forms the power feeding path, it is not necessary to additionally provide a power feeding member.

When assembling the imaging unit 15, the conduction portion 158 is fixed to the upper housing 106 by the bolt 162, and the longitudinal other end portion 144R of the board 144 of the LPH 73 is grounded to the apparatus ground through the plate spring member 156R, the plate ground 192, and the spring ground 190. The longitudinal one end portion 144L of the board 144 of the LPH 73 and the support shaft 29 of the photosensitive member 28 are put into electric conduction by the conduction portion 158, and the spring ground 190 abuts on the support-shaft other end portion 29R of the photosensitive member 28. Therefore, the longitudinal one end portion 144L of the board 144 of the LPH 73 is also grounded. Accordingly, both the longitudinal end portions of the board 144 of the LPH 73 can be grounded without drawing the long ground wire.

The longitudinal one end portion 144L of the board 144 of the LPH 73 is grounded such that the longitudinal one end portion 144L and the support shaft 29 of the photosensitive member 28, which is the long member located closest to the longitudinal one end portion 144L of the board 144 of the LPH 73, are put into electric conduction by the conduction portion 158. Accordingly, both the longitudinal end portions of the board 144 of the LPH 73 have the simple ground structures.

Even if the intermediate housing 104 retaining the LPH 73 is made of an insulating material such as resin, the board 144 of the LPH 73 is easily grounded.

The plate spring member 156R urges the LPH 73 toward the longitudinal other end portion 144R of the LPH 73, and the longitudinal other end portion 144R of the LPH 73 abuts on the inner wall of the intermediate housing 104. Accordingly, the LPH 73 in the longitudinal direction is aligned with respect to the intermediate housing 104 by the urging force of the plate spring member 156R.

The conduction portion 158 is fixed to the upper housing 106 by the bolt 162, the plate spring member 160 (or the helical compression spring 170) urges (presses) the support shaft 29 of the photosensitive member 28 toward the support-shaft other end portion 29R, and the plate spring member 160 (or the helical compression spring 172) urges (presses) the intermediate housing 104 toward the longitudinal other end portion 144R of the LPH 73 via the plate spring member 156L. Therefore, the position of the intermediate housing 104 in the longitudinal direction (the position of the LPH in the longitudinal direction or the position of the photosensitive body in the longitudinal direction) is aligned with respect to the upper housing 106. That is, LPH 73 in the longitudinal direction is aligned with respect to the intermediate housing 104, and the intermediate housing 104 in the longitudinal direction is aligned with respect to the upper housing 106, thereby aligning the LPH 73 in the longitudinal direction with respect to the upper housing 106. Each of four LPHs is aligned with the single upper housing, and the relative position therebetween in the longitudinal direction is substantially kept constant. Therefore, the color images are hardly deviated from one another, and the assembly productivity of the imaging unit 15 is improved.

The alignment and grounding are simultaneously performed only by assembling the conduction portion 158 in the imaging unit 15, so that the assembly productivity of the imaging unit 15 is improved.

The reliability is enhanced from the viewpoint of strength when the conduction portion 158 is configured to include the helical compression springs 170 and 172 and the cap member 174.

In the exemplary embodiment, the longitudinal one end portion 144L of the board 144 of the LPH 73 and the support-shaft one end portion 29L of the photosensitive member 28 are put into electric conduction by the conduction portion 158, and the support-shaft other end portion 29R of the photosensitive member 28 is grounded, thereby the both the longitudinal end portions of LPH 73 are grounded. Alternatively, a conductive long member is provided for reinforcement or the like, and the LPH 73 may be grounded using the long member. That is, the long member is provided in parallel with the LPH 73, the longitudinal one end portion 144L of the board 144 of the LPH 73 and the longitudinal end portion of the long member are put into electric conduction, and the longitudinal other end portion of the long member is grounded. In such a configuration, the similar operation and effect are obtained.

Although the exemplary embodiment of the invention is described above, the exemplary embodiment is only by way of example, and various modifications can be made without departing from the scope of the invention. Obviously the scope of the invention is not limited to the exemplary embodiment.

What is claimed is:

1. An image forming unit comprising:

a development unit that includes a development member;

a photosensitive unit that includes a photosensitive member;

a transfer unit that is disposed to face the photosensitive member; and an elastic member that is attached to the transfer unit and the development unit and urges the development unit toward the transfer unit to align the development unit and the photosensitive member with each other.

2. The image forming unit of claim 1, wherein a support shaft of the photosensitive member pierces a housing of the transfer unit and the photosensitive member.

3. The image forming unit of claim 2, wherein hole portions through which both ends of the support shaft of the photosensitive member penetrate respectively are formed at the housing of the transfer unit.

4. The image forming unit of claim 1, wherein a latch structure is formed to temporarily join the photosensitive unit and the development unit.

5. The image forming unit of claim 4, wherein the elastic member is a helical tension spring that forms a power feeding path to the development member.

6. The image forming unit of claim 4, wherein the latch structure is configured to include an opening formed at one of the photosensitive unit or the development unit, and a protrusion, that is engaged with the opening, formed at the other of the photosensitive unit or the development unit.

7. The image forming unit of claim 1, wherein one end of the elastic member is latched to a latch portion formed at the transfer unit, and another end of the elastic member is latched to one end of a support shaft of a development roll serving as the development member.

8. An image forming apparatus comprising an image forming unit including: a development unit that includes a development member; a photosensitive unit that includes a photosensitive member; a transfer unit that is disposed to face the photosensitive member; and an elastic member that is attached to the transfer unit and the development unit and urges the development unit toward the transfer unit to align the development unit and the photosensitive member with each other.

* * * * *